US009102143B2

(12) United States Patent
Araki

(10) Patent No.: US 9,102,143 B2
(45) Date of Patent: Aug. 11, 2015

(54) METHOD OF SETTING MAINTENANCE REGIONS POSTERIOR TO UNAVAILABLE PRINTING REGIONS IN DUPLEX PRINTER

(71) Applicant: CANON KABUSHIKI KAISHA, Tokyo (JP)

(72) Inventor: Yuichiro Araki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 13/955,051

(22) Filed: Jul. 31, 2013

(65) Prior Publication Data

US 2014/0037354 A1 Feb. 6, 2014

(30) Foreign Application Priority Data

Jul. 31, 2012 (JP) ..... 2012-169937

(51) Int. Cl.

| | |
|---|---|
| ***B41J 29/38*** | (2006.01) |
| ***B41J 3/60*** | (2006.01) |
| ***B41J 11/42*** | (2006.01) |
| ***B41J 2/07*** | (2006.01) |
| ***B41J 11/00*** | (2006.01) |
| *B41J 29/393* | (2006.01) |

(52) U.S. Cl.

CPC .... *B41J 2/07* (2013.01); *B41J 3/60* (2013.01); *B41J 11/008* (2013.01); *B41J 11/42* (2013.01); *B41J 29/38* (2013.01); *B41J 2029/3935* (2013.01)

(58) Field of Classification Search

CPC ..... B41J 2029/3935; B41J 3/60; B41J 11/42; B65H 2301/544

See application file for complete search history.

(56) References Cited

U.S. PATENT DOCUMENTS

| | | | | |
|---|---|---|---|---|
| 4,268,943 | A | 5/1981 | Watanabe et al. | |
| 4,317,270 | A | 3/1982 | Watanabe et al. | |
| 5,532,799 | A | 7/1996 | Watanabe et al. | |
| 5,915,146 | A | 6/1999 | Kusaka et al. | |
| 6,179,287 | B1 | 1/2001 | Watanabe et al. | |
| 6,240,263 | B1 | 5/2001 | Watanabe et al. | |
| 6,575,546 | B2 | 6/2003 | Matsumoto et al. | |
| 7,050,751 | B2 | 5/2006 | Watanabe et al. | |
| 2005/0231583 | A1 * | 10/2005 | Maghakian | 347/191 |

(Continued)

FOREIGN PATENT DOCUMENTS

| | | |
|---|---|---|
| JP | H03-197140 | 8/1991 |
| JP | 2002-046260 | 2/2002 |
| JP | 2003-237157 | 8/2003 |
| JP | 4278885 | 6/2009 |

(Continued)

*Primary Examiner* — Daniel J Colilla

(74) *Attorney, Agent, or Firm* — Fitzpatrick, Cella, Harper & Scinto

(57) ABSTRACT

When a plurality of images is printed on both the surfaces of a continuous sheet, an optimum scheduling is carried out including maintenance of a print head, thereby suppressing amount of consumption of a sheet as a whole. For such a purpose, acquiring information regarding on which of the first and second surfaces and where on the surface of the continuous sheet a unique portion exists, the unique portion is unsuitable for image printing that exists on the continuous sheet; and setting, based on the acquired information, a print unavailable region including the unique portion and a maintenance region posterior thereto on a specific sheet surface having the unique portion existing thereon, and another print unavailable region and a maintenance region posterior thereto on a reverse side of the specific sheet surface, the another print unavailable region being set so as to include a region corresponding to the maintenance region.

15 Claims, 16 Drawing Sheets

(56) References Cited

U.S. PATENT DOCUMENTS

| | | | | |
|---|---|---|---|---|
| 2011/0279508 | A1 | 11/2011 | Naito | |
| 2011/0310151 | A1* | 12/2011 | Serizawa | 347/14 |
| 2013/0088541 | A1 | 4/2013 | Naito | |

FOREIGN PATENT DOCUMENTS

| | | |
|---|---|---|
| JP | 2011-240492 | 12/2011 |
| JP | 2011-240493 | 12/2011 |

* cited by examiner

METHOD OF SETTING MAINTENANCE REGIONS POSTERIOR TO UNAVAILABLE PRINTING REGIONS IN DUPLEX PRINTER

BACKGROUND OF THE INVENTION

1. Field of the Invention

The present invention relates to a technology for executing duplex printing of a plurality of images on a continuous sheet.

2. Description of the Related Art

A continuous sheet for printing may include a unique portion which is region composed of a part of the sheet whose characteristic differs from the rest of the sheet, the unique portions unintentionally created in the sheet manufacturing process. If the image is printed on such the region in which unique portion exists, the image cannot be obtained as a good product.

Japanese Patent Laid-Open No. 2011-240493 discloses a method for executing duplex printing on a continuous sheet including unique regions inappropriate for printing, wherein the printing is executed while avoiding the unique regions on the obverse surface and the reverse surface of a sheet in consideration of the unique regions on both the surfaces of the sheet. In this method, when the unique portion on the continuous sheet is detected during the printing on the first surface, a unavailable region is set in the print schedule for a first surface, and a unavailable region at the position corresponding to the unique portion on the first surface is also set in a second surface print schedule, thereby continuing the printing.

The apparatus described in Japanese Patent Laid-Open No. 2011-240493 is not one in which an optimization is done to the extent of a schedule of maintenance (head maintenance) for a preliminary ejection 3 and the like, which is necessary for ink jet printing, so that it is susceptible to improvement.

SUMMARY OF THE INVENTION

An object of the present invention is to provide a technique capable of suppressing the amount of consumption of a sheet as a whole when printing an image on both the surfaces of a continuous sheet by carrying out an optimum scheduling including maintenance of a print head.

Accordingly, a feature of the present invention is a print control method for printing a plurality of images on a first surface and a second surface of a continuous sheet, the method comprising: acquiring information regarding on which of the first and second surfaces and where on the surface of the continuous sheet a unique portion exists, the unique portion is unsuitable for image printing that exists on the continuous sheet; and setting, based on the acquired information, a print unavailable region including the unique portion and a maintenance region posterior thereto on a specific sheet surface having the unique portion existing thereon, and another print unavailable region and a maintenance region posterior thereto on a reverse side of the specific sheet surface, the another print unavailable region being set so as to include a region corresponding to the maintenance region.

According to the present invention, when a plurality of images is sequentially printed on both the surfaces of a continuous sheet, an optimum scheduling is carried out including maintenance of a print head even if a unique portion exists on the sheet, thereby suppressing the amount of consumption of a sheet as a whole.

Further features of the present invention will become apparent from the following description of exemplary embodiments (with reference to the attached drawings).

DESCRIPTION OF THE EMBODIMENTS

Embodiments of the present invention will be described below with reference to drawings. A printing apparatus of the present invention uses a long, continuous sheet for printing (a continuous sheet longer than a length of a print unit (which is referred to as one page or a unit image) that is repeated in a conveyance direction), and is a high-speed line printer capable of both simplex printing and duplex printing. For example, such the printing apparatus is suited to fields in which a large quantity of sheets is printed, such as at a print lab.

In addition, in this specification, even if a plurality of small images, characters, or blanks, is included in a region of one print unit (one page), objects included in the region are collectively referred to as one unit image. More specifically, the unit image means one print unit (one page) in a case where a plurality of pages is sequentially printed on the continuous sheet. Instead of the unit image, simply an image may be used.

The present invention is widely applicable to a printing apparatus which uses ink and is required to be dried, such as a printer, a multifunction printer, a copying machine, a facsimile machine, manufacturing apparatus of various devices.

Figure 1:
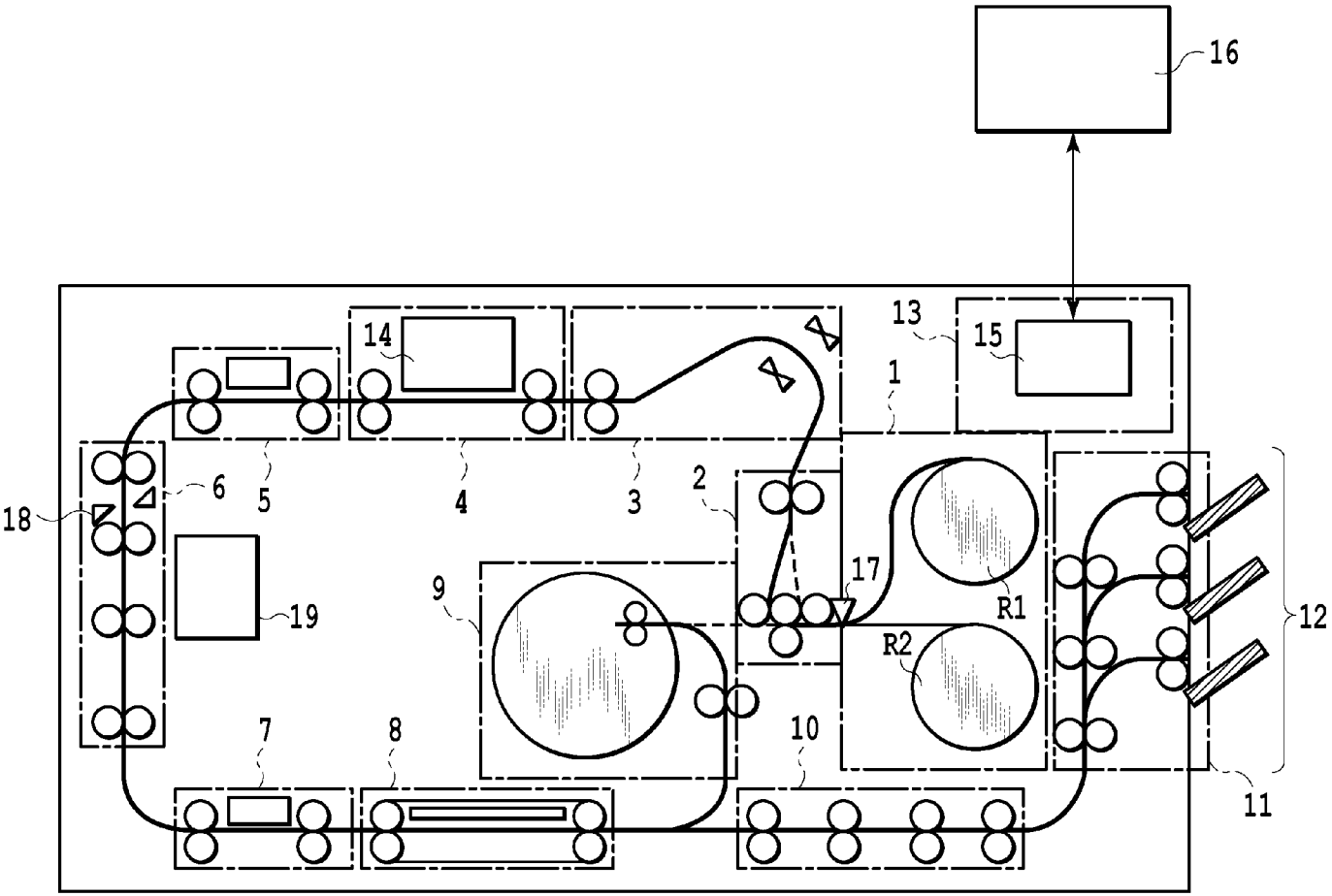
FIG. 1 is a cross-sectional schematic diagram showing an internal structure of a printing apparatus.

FIG. 1 is a cross-sectional schematic diagram showing an internal structure of a printing apparatus to which the present embodiment is applicable. The printing apparatus of the present embodiment can print on both a first surface and a second surface of a sheet using a sheet wound in a roll shape, where the second surface is on the back side of the first surface. Roughly speaking, the inside of the printing apparatus provides each of the units, i.e., a sheet feeding unit 1, a decurling unit 2, a positional deviation correction unit 3, a printing unit 4, an inspection unit 5, a cutter unit 6, an information recording unit 7, a drying unit 8, a reversing unit 9, a discharge conveyance unit 10, a sorter unit 11, a discharge unit 12, and a control unit 13.

The discharge unit 12 refers to the unit which includes the sorter unit 11 and performs discharge processing of the sheet after printed. The sheet is conveyed by a conveyance mechanism composed of pairs of rollers and belts along a sheet conveyance path indicated by solid lines in the figure, and then processed at each unit. In addition, at an arbitrary position on the sheet conveyance path, a side closer to the sheet feeding unit 1 is referred to as an "upstream" side and an opposite side is referred to as a "downstream" side.

The sheet feeding unit 1 is the unit for holding and feeding the continuous sheet wound in a roll shape. The sheet feeding unit 1 is structured to be able to accommodate two rolls R1 and R2, and to alternatively draw and feed the sheet. In addition, the rolls that can be accommodated are not limited to two, but one or three or more rolls may be accommodated. Furthermore, the sheet is not limited to a roll shape type as long as it is a continuous sheet. Furthermore, the sheet is not limited to a sheet wound in a roll shape, as long as it is a continuous sheet. For example, the sheet may be used in which a continuous sheet having perforations for each unit length applied thereto is folded back at each perforation and stacked, and then accommodated in the sheet feeding unit 1.

The continuous sheet used here is one having marks which are previously recorded in order that unique portions such as stains can be detected. The unique portions are regions that are unsuitable for printing an image as a final product. A mark sensor 17 is provided in the vicinity of an outlet of the sheet feeding unit 1 so as to detect marks applied on the continuous sheets that is fed from the sheet feeding unit 1.

The decurling unit 2 is the unit which reduces a curl (warpage) of the sheet fed from the sheet feeding unit 1. The decurling unit 2 uses two pinch rollers for one drive roller to pass the sheet therethrough while curving the sheet so as to give the sheet the curling in a direction opposite to the curling thereof, so that a decurling force operates to reduce the curling.

The positional deviation correction unit 3 is the unit which corrects a positional deviation (tilt with respect to the original traveling direction) of the sheet which has passed through the decurling unit 2. The positional deviation of the sheet can be corrected by pressing an end portion of the sheet on a reference side against a guide member. A loop is formed on the sheet being conveyed in the positional deviation correction unit 3. The printing unit 4 is a sheet processing unit that performs print processing on the sheet being conveyed by a print head 14 from above to form an image. More specifically, the printing unit 4 is a processing unit that performs predetermined processing on the sheet.

The printing unit 4 is also provided with a plurality of conveying rollers for conveying the sheet. The print head 14 is provided with a line type print head in which an inkjet nozzle array is formed over a range that covers the maximum width of the sheet that is expected to be used. The print head 14 has a plurality of print heads aligned in parallel along the conveying direction. In the present embodiment, it is provided seven print heads corresponding to seven colors of cyan (C), magenta (M), yellow (Y), light cyan (LC), light magenta (LM), grey (G), and black (K). In addition, the number of colors and the number of print heads are not limited to seven.

As the ink jet method, methods can be employed such as a method using a heating element, a method using a piezoelectric element, a method using an electrostatic element, and a method using an MEMS element. Each color ink is supplied from an ink tank to the print head 14 via each ink tube.

The inspection unit 5 is the unit which uses a scanner to optically read an inspection pattern and an image that the printing unit 4 has printed on the sheet, and inspects the nozzle state in the print head, the sheet conveying state, the image position and the like, thereby determining whether the image is correctly printed. The scanner has a CCD image sensor and a CMOS image sensor.

The cutter unit 6 is the unit which is provided with a mechanical cutter 18 for cutting the sheet after printed to a predetermined length. The cutter unit 6 is also provided with a cut mark sensor for optically detecting cut marks recorded on the sheet, and a plurality of conveying rollers for delivering the sheet to the next step. A waste box 19 is provided in the vicinity of the cutter unit 6. The waste box 19 is for accommodating small sheet fragments which are produced by being cut with the cutter unit 6 and discharged as waste. The cutting unit 6 is provided with a separating mechanism that discharges the cut-off sheet to the waste box 19 or brings the cut sheets to the original conveying path.

The information recording unit 7 is the unit which records printing information (unique information), such as print serial numbers and dates, in nonprinting regions of the cut-off sheet. The printing information is recorded by printing characters and codes using an ink jet method, a thermal transfer method, and the like.

The drying unit 8 is the unit which heats the sheet undergone the printing at the printing unit 4 so as to dry the ink applied thereto in a short time. Inside of the drying unit 8, hot air is applied to the sheet passing therethrough at least from the underside surface thereof to dry the surface on which ink is applied. In addition, the drying method is not limited to applying hot air, but may be the method for irradiating the sheet surface with electromagnetic waves (such as ultraviolet rays and infrared rays).

The sheet conveying path from the sheet feeding unit 1 to the drying unit 8 described above is referred to as a first path. The first path has a shape of making U-turn between the printing unit 4 and the drying unit 8, and the cutter unit 6 is located halfway through the U-turn shape.

The reversing unit 9 is the unit which, in a case where the duplex printing is executed, temporarily rolls up the continuous sheet in which the printing on the obverse surface is completed, and turns over the obverse and reverse surfaces. The reversing unit 9 is provided midway of a path (loop path) (referred to as a second path) from the drying unit 8 to the printing unit 4 via the decurling unit 2 for supplying the sheet passed through the drying unit 8 to the printing unit 4 again. The reversing unit 9 is provided with a winding rotary body (drum) that rotates to roll up the sheet.

The continuous sheet, which has undergone the printing on the obverse surface and is not cut yet, is temporarily rolled up by the winding rotary body. When finishing the rolling up, the winding rotary body inversely rotates to deliver the rolled sheet in an inverse sequence to the rolling up. The sheet is fed to the decurling unit 2, and then sent to the printing unit 4.

Since the obverse and reverse surfaces of the sheet are reversed, the printing can be executed on the reverse surface at the printing unit 4. If the sheet feeding unit 1 is a first sheet feeding unit, the reversing unit 9 can be regarded as a second sheet feeding unit. More specific operation of duplex printing will be described below.

The discharge conveyance unit 10 is the unit which conveys the sheet that is cut at the cutter unit 6 and dried at the drying unit 8 to pass the sheet to the sorter unit 11. The discharge conveyance unit 10 is provided in a path (referred to as a third path) separate from the second path in which the reversing unit 9 is provided. In order to selectively guide the sheet conveyed through the first path to one of the second or third path, a path switching mechanism having a movable flapper is provided at the branching point of the path (referred to as a "discharge branching position").

The discharge unit 12 including the sorter unit 11 is provided by a side of the sheet feeding unit 1 and at the end of the third path. The sorter unit 11 is the unit for sorting the printed sheets by group, as necessary. The sorted sheets are discharged into a plurality of trays that the discharge unit 12 has. In this way, the third path has a layout which passes below the sheet feeding unit 1 and discharges the sheet to a side opposite to the printing unit 4 and the drying unit 8 across the sheet feeding unit 1.

As described above, the first path includes the units sequentially provided from the sheet feeding unit 1 to the drying unit 8. The path ahead of the drying unit 8 branches into the second path and the third path. The reversing unit 9 is provided midway of the second path, and the path ahead of the reversing unit 9 merges to the first path. The discharge unit 12 is provided at the end of the third path.

The control unit 13 is the unit responsible for controlling each of units in the entire printing apparatus. The control unit 13 has a CPU, a storage device, a controller provided with various control units, an external interface, and an operating unit 15 by which a user carries out the input and output. The operation of the printing apparatus is controlled based on instructions from a controller, or a host device 16, such as a host computer, which is connected via the external interface connected to the controller.

Figure 2:
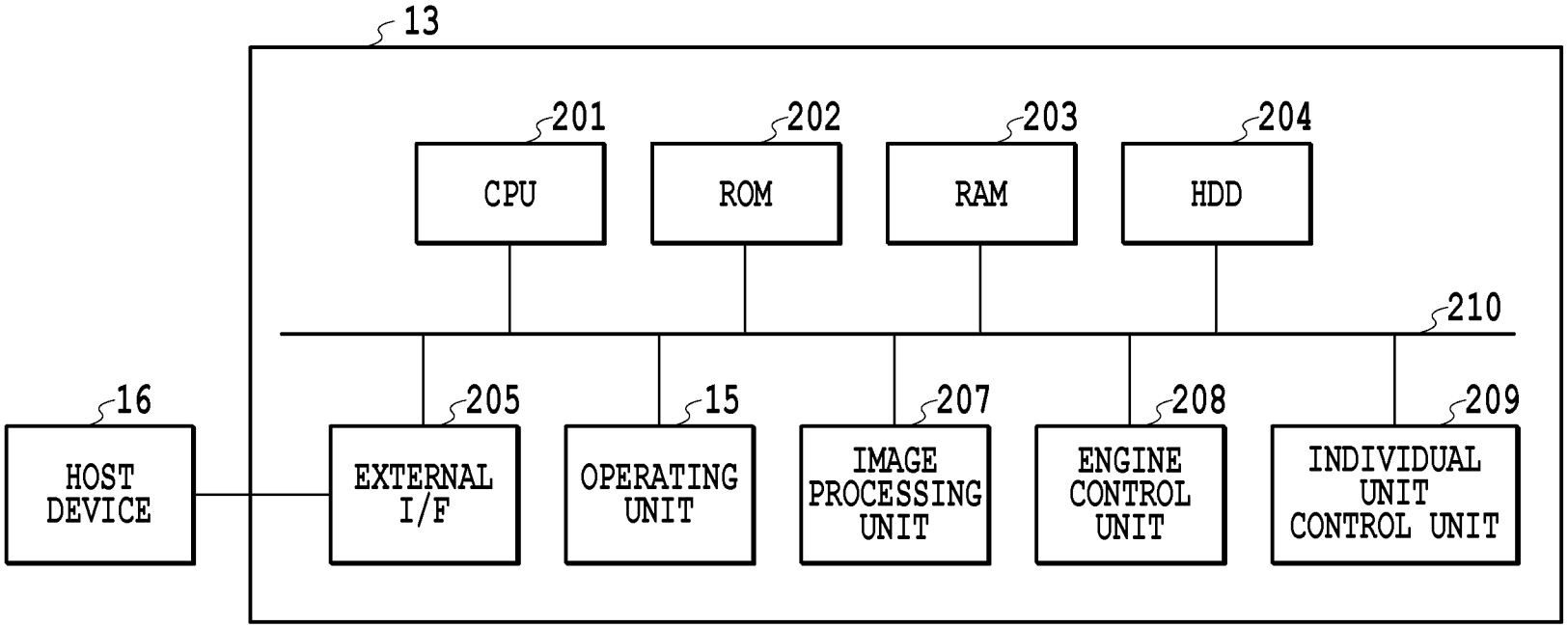
FIG. 2 is a block diagram showing the concept of the control unit.

FIG. 2 is a block diagram showing the concept of the control unit 13. The controller (a region surrounded by a broken line) included in the control unit 13 is composed of a CPU 201, a ROM 202, a RAM 203, an HDD 204, an image processing unit 207, an engine control unit 208, and an individual unit control unit 209. The CPU (central processing unit) 201 integratively controls the operation of each of the units in the printing apparatus. The ROM 202 stores a program that the CPU 201 is to execute, and a fixed data required for various operations of the printing apparatus.

The RAM 203 is used as a work area for the CPU 201, is used as a temporary storage area of a variety of received data, and stores various setting data. The HDD (hard disc) 204 can store and read out a program that the CPU 201 is to execute, printing data, and setting information required for various operations of the printing apparatus. The operating unit 15 is an input/output interface for a user, and includes an input unit such as hard keys and a touch panel, and an output unit such as a display and an audio generator for providing information.

Dedicated processing units are provided for the units to which a high-speed data processing is required. The image processing unit 207 carries out image processing of printing data handled by the printing apparatus. The color space (for example, YCbCr) of the input image data is converted to a standard RGB color space (for example, sRGB). Furthermore, a variety of image processing, such as resolution conversion, image analysis, image correction, etc., is carried out on the image data as necessary. The printing data acquired by the image processing is stored in the RAM 203 or the HDD 204.

The engine control unit 208 carries out the drive control of the print head 14 of the printing unit 4 in accordance with the printing data based on the control commands received from the CPU 201 and the like. The engine control unit 208 also controls the conveyance mechanism of each of the units in the printing apparatus. The individual unit control unit 209 is a sub-controller for individually controlling each of the units, i.e., the sheet feeding unit 1, the decurling unit 2, the positional deviation correction unit 3, the inspection unit 5, the cutter unit 6, the information recording unit 7, the drying unit 8, the reversing unit 9, the discharge conveyance unit 10, the sorter unit 11, and the discharge unit 12.

The individual unit control unit 209 controls the operation of each of the units based on the commands from the CPU 201. An external interface 205 is an interface (I/F) for connecting the controller to the host device 16, and is a local I/F or a network I/F. The components described above are connected via a system bus 210.

The host device 16 is the device as being a supply source of image data so that the printing apparatus executes the printing. The host device 16 may be a general-use or dedicated computer, or may be dedicated image equipment, such as image capturing equipment having an image reader unit, a digital camera, or a photo-storage. In a case where the host device 16 is a computer, an OS, application software for generating image data, and printer driver for the printing apparatus are installed in the storage device included in the computer. In addition, all processing described above does not necessarily have to be achieved by software, but a part or all of them may be achieved by hardware.

Then, the basic operation at the time of printing will be described. In the printing operation, the operation in the simplex printing mode is different from that in the duplex printing mode, so that each operation will be described separately. First, in the simplex printing mode, the sheet is fed from the sheet feeding unit and processed at each of the decurling unit 2 and the positional deviation correcting unit 3, followed by undergoing the printing on the obverse surface (first surface) at the printing unit 4. Images having a predetermined unit length (unit images) in the conveying direction are printed in sequence on the long continuous sheet to form an alignment of a plurality of images on the sheet.

The printed sheet is conveyed through the inspection unit 5 to the cutting unit 6 where the sheet is cut into unit images. The information recording unit 7 records printing information on the reverse surface of the sheet that has been cut (the cut sheet) as required. Then, the cut sheet is conveyed to the drying unit 8 one by one, where it is dried. Then, the cut sheets are conveyed through the discharge conveyance unit 10 and sequentially discharged into the discharge unit 12 of the sorter unit 11 to be stacked there. On the other hand, the rest of the sheet that is left on the side of the printing unit 4 at the time of cutting the last unit image is sent back to the sheet feeding unit 1, and is rolled up to the roll R1 or R2. In this way, in the simplex printing, the sheet is processed through the first and third paths, but does not pass through the second path.

On the other hand, in the duplex printing mode, the obverse surface (first surface) printing sequence is executed, followed by the reverse surface (second surface) printing sequence. In the obverse surface printing sequence that is to be firstly executed, the operation of each of the units from the sheet feeding unit 1 to the inspection unit 5 is the same as the operation in the simplex printing described above. The sheet is not cut at the cutter unit 6, but is conveyed to the drying unit 8 as being the continuous sheet. The ink on the obverse surface is dried at the drying unit 8, and then the sheet is guided not to the path on the side of the discharge conveyance unit 10 (third path), but to the path on the side of the reversing unit 9 (second path).

In the second path, the sheet is rolled up by the winding rotary body of the reversing unit 9 that rotates in the forward direction (counterclockwise in figure). When all of the scheduled printing on the obverse surface at the printing unit 4 is completed, the cutter unit 6 cuts the continuous sheet at the trailing edge of the printing area of the continuous sheet. Relative to the cut position, the continuous sheet on the downstream side of the conveying direction (printed side) is completely rolled up to the trailing edge of the sheet (cut position) at the reversing unit 9 through the drying unit 8.

On the other hand, simultaneously to the winding at the reversing unit 9, the continuous sheet that is left on the upstream side of the conveying direction (the side of the printing unit 4) from the cutting position is sent back to the sheet feeding unit 1 to roll up the sheet onto the roll R1 or R2 so that the leading edge (cutting position) of the sheet does not remain in the decurling unit 2. The sending back (backfeeding) enables the sheet to be prevented from colliding with a sheet supplied again in the reverse surface printing sequence described below.

After the obverse surface printing sequence described above, the sequence is switched to the reverse surface printing sequence. The winding rotary body of the reversing unit 9 rotates in a direction opposite to that during rolling up (clockwise in figure). The edge of the rolled up sheet (the trailing edge of the sheet at the time of rolling up is the leading edge at the time of delivering) is fed to the decurling unit 2 along the path represented by a broken line in figure. The curling of the sheet applied at the winding rotary body is corrected at the decurling unit 2.

More specifically, the decurling unit 2 is provided between the sheet feeding unit 1 and the printing unit 4 in the first path and between the reversing unit 9 and the printing unit 4 in the second path, so as to be provided as the unit for executing the decurling that is common to both paths. The sheet whose obverse and reverse surfaces have been reversed is conveyed through the positional deviation correction unit 3 to the printing unit 4, where printing is executed on the reverse surface of the sheet. The printed sheet is conveyed through the inspection unit 5 and is cut at the cutter unit 6 for each predetermined unit length set in advance.

The printing is applied to both surfaces of the cut sheets, so that the information is not recorded at the information recording unit 7. The cut sheets are conveyed one by one to the drying unit 8, and sequentially discharged and stacked in the discharge unit 12 of the sorter unit 11 through the conveying unit 10. In this way, in the duplex printing, the sheet passes through in sequence the first path, the second path, and the third path in order to be processed.

Then, a unique portion existing in the continuous sheet will be described in detail. The unique portion refers to a region which is a part of the continuous sheet having the feature different from that of the rest of the sheet, i.e., the region which includes stains, bores, flaws, connecting portions between the sheets, folds, tears, admixture of foreign matters, discoloration, uneven thickness, impurities, and the like.

A mark for identifying the unique portion is the mark which is recorded within the predetermined range and anterior and posterior thereto to the unique portion on the sheet taking the deviation into consideration, and refers to the existence of the unique portion at the marked position. More specifically, the unique portion mark is recorded as information indicating the position of the unique portion. The unique portion mark is previously recorded at the time of manufacturing the sheet, and is not recorded by the printing apparatus of the embodiment.

The unique portion mark may be one that can be detected by the mark sensor 17, such as a simple rectangle, a bar code, a QR code, a specific pictorial figure, and a character. In addition to that, the mark is recorded in a state where it can be determined whether the unique region is located on the first surface of the sheet, or on the second surface that corresponds to the reverse side thereof. The mark is recorded at the position in the vicinity of each of the unique portions and slightly away from the downstream side of the unique portion (front end side of the roll paper).

In addition, the information indicating the position of the unique portion existing on the sheet is not limited to one that is recorded as the unique portion mark in the middle of the sheet, but may be one that is recorded collectively in the form of the bar code, for example, at the front end of the sheet. Furthermore, the information is not necessarily recorded on the sheet itself, but the structure may be employed in which the information is collectively recorded on a package for packing the sheet to be input by a user to the host device. Furthermore, the structure may be employed in which a memory media in which the information is collectively recorded is attached to the package of the sheet and a user inputs the information to the host device. The information is acquired by reading out the information input in the host device.

In the printing apparatus of the present embodiment, the mark sensor 17 is provided as an optical sensor on the side of the sheet feeding unit 1. Furthermore, the mark for identifying the unique portion of the roll of paper is recorded only on the first surface in a state where it can be determined whether the unique portion is located on the first surface of the sheet, or on the second surface that corresponds to the reverse side thereof. More specifically, the marked portion cannot be detected when the sheet is fed from the reversing unit 9 when the printing is executed on the second surface, so that the position of the marked portion upon printing on the second surface is estimated from the data based on the detection of the marked portion upon printing on the first surface, and then the avoiding operation is carried out.

Figure 3B:
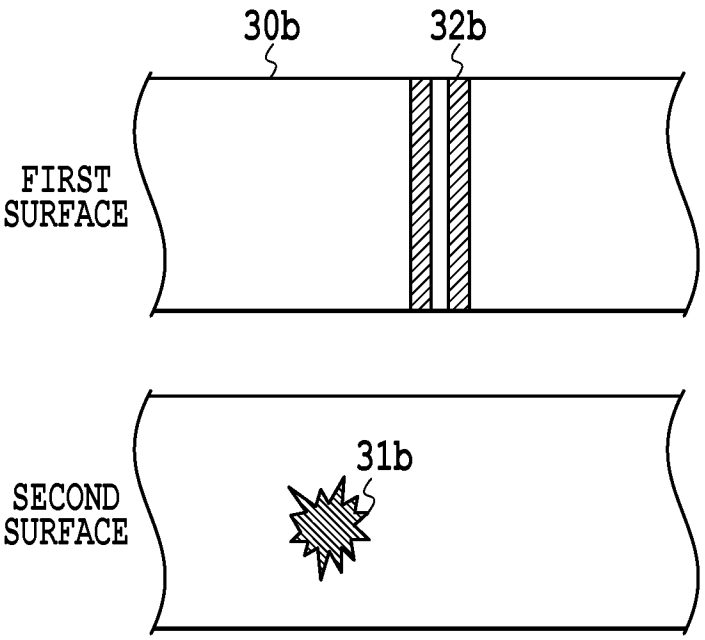
FIGS. 3A and 3B are diagrams showing a mark recorded on a continuous sheet.
Figure 3A:
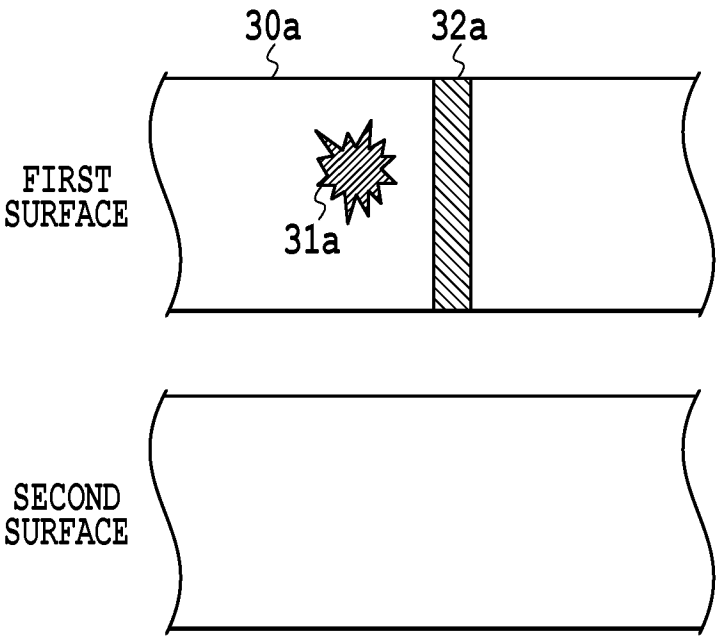

FIGS. 3A and 3B are diagrams showing marks recorded on the continuous sheet. The continuous sheet may include a unique portion, such as a stain and a connecting portion between the sheets, which is a region composed of a part of the sheet whose characteristic differs from the rest of the sheet in order to reduce the manufacturing cost. When the continuous sheet is stained in the manufacturing process, regarding the entire continuous sheet as being defective due to a partial defect may result in increase in the manufacturing cost.

Furthermore, the sheets having the length less than the predetermined length which are produced in the manufacturing process are not suitable for products as they are, but there is no problem in terms of the quality. Therefore, a single sheet may be made by joining these sheets. The region on the continuous sheet including the unique portion, such as a stain and a connecting portion between the sheets, is the region that is inappropriate for printing an image as a final product. Then, a mark is previously recorded in the vicinity of the unique portion at the time of manufacturing the continuous sheet, and is detected at the time of printing. The printing is thus executed while avoiding the region including the unique portion and the mark (hereinafter referred to as a unique region).

FIG. 3A is a diagram showing a mark in the case where the unique portion on the continuous sheet is located on the first surface. The upper side is the first surface and the lower side is the reverse side thereof (the second surface located at the same position as the first surface). A stain 31*a* that is a unique portion is located on the first surface of the continuous sheet 30*a*, and a single line-shaped mark 32*a* indicating that the unique portion is located on the first surface is recorded in the vicinity thereof on the reverse side. There is no unique portion such as a stain on the reverse side thereof.

FIG. 3B is a diagram showing a mark in the case where the unique portion on the continuous sheet is located on the second surface. The upper side is the first surface and the lower side is the reverse side thereof (the second surface located at the same obverse/reverse position as the first surface). A stain 31*b* that is a unique portion is located on the second surface of the continuous sheet 30*b*, and two line-shaped mark 32*b* indicating that the unique portion is located on the second surface is recorded in the vicinity thereof on the reverse side, i.e., on the first surface.

In the FIG. 3B, there is no unique portion such as a stain even in the vicinity of the mark 32*b*. In addition, the mark is not limited to the line-shaped mark as illustrated in the present invention. Furthermore, in addition to the recording at the time of manufacturing, the mark can be formed by a tape, a notch, a bore and the like.

Figure 4:
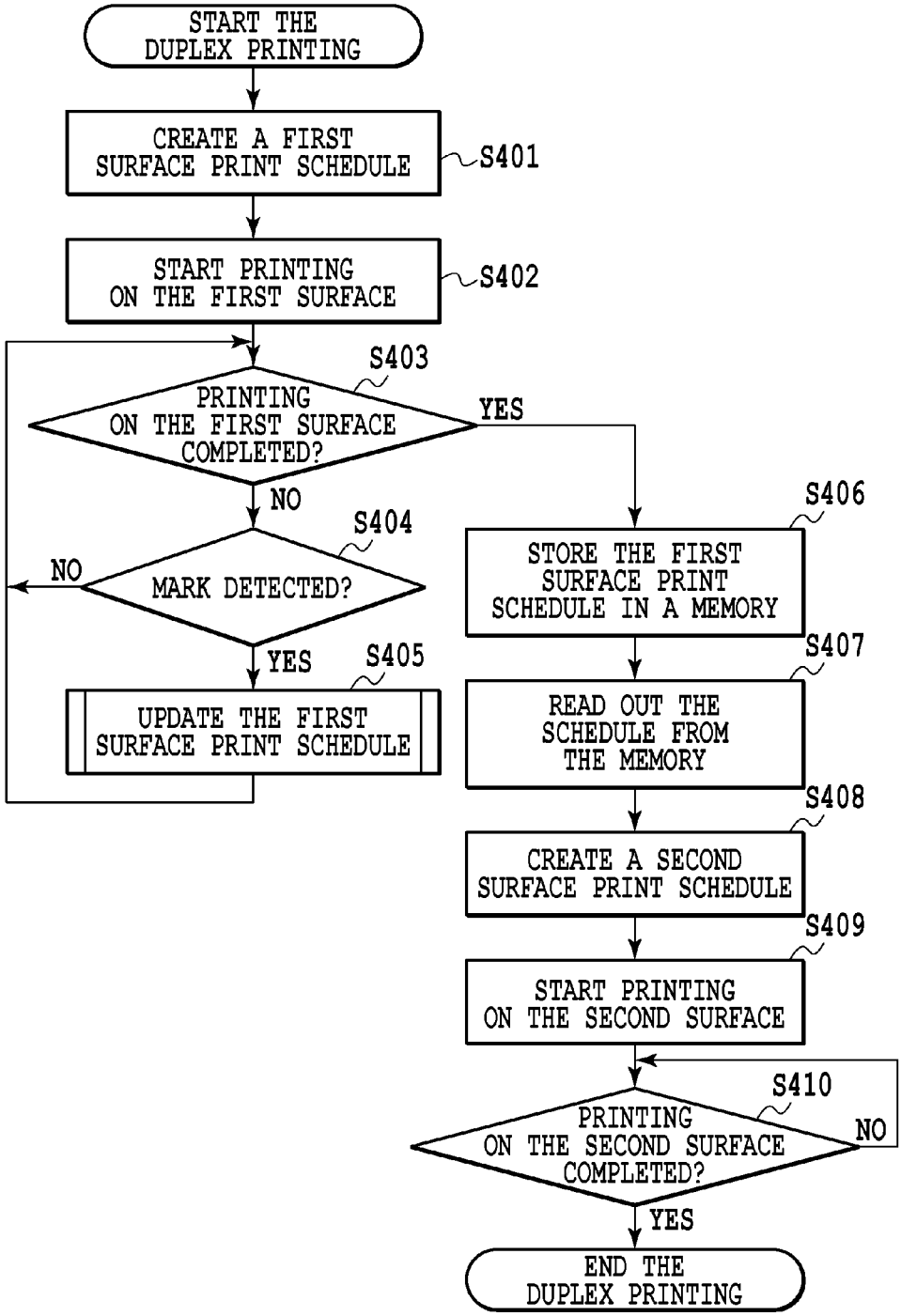
FIG. 4 is a flow chart showing an operational sequence of the duplex printing.

FIG. 4 is a flow chart showing an operational sequence of the duplex printing. The processing in the printing operation will be described below along the flow chart. The processing is achieved by the control by the control unit 13.

At step S401, a first surface print schedule is created based on the instruction of printing. The first surface print schedule is the data that defines the sequence of items such as a plurality of unit images to be sequentially printed on the first surface of the continuous sheet, cut marks formed in a margin region between the images adjacent to each other, a preliminary ejection pattern, an ejection failure monitoring pattern, a margin region. In addition, the preliminary ejection pattern is the pattern of ejection of ink that does not contribute to printing, and the preliminary ejection is executed as a part of maintenance operations of the print head. The procedure proceeds to step S402, and, at step S402, the unit images and maintenance patters are sequentially printed on the continuous sheet in the predetermined order in accordance with the first surface print schedule that is created at step S401.

Then, at step S403, it is determined whether all of the printings on the first surface defined in the first surface print schedule are completed (YES) or not (NO). If it is determined to be YES at step S403, a first surface print sequence for is terminated and the procedure proceeds to step S406. In contrast, if it is determined to be NO at step S403, the procedure proceeds to step S404.

At step S404, it is determined whether the mark sensor 17 detects the marked portion on the continuous sheet during the printing. IF it is determined to be YES, the procedure proceeds to step S405. If it is determined to be NO, the procedure returns to step S403 to repeat the processing.

At step S405, the update processing of the first surface print schedule is executed. The update processing of the print schedule executes setting of the print unavailable region corresponding to the detected mark and insertion of the preliminary ejection region. Step S405 will be described in detail using FIG. 5. The termination of the printing on the first surface is determined at step S403. The procedure proceeds to step S406, and the latest first surface print schedule is stored in the memory (the RAM or HDD) of the control unit. If the originally generated schedule is not deleted, that can be maintained without storing a new one.

At step S407, the data in the schedule recorded in the memory is read out. Then, the second surface print schedule is created at step S408. The creating of the schedule is executed based on the first surface print schedule read out at step S407. This is because it is necessary to correctly align the unit images with the unit images printed on the first surface so as to print them on the second surface. When the print unavailable region is set in the first surface print schedule, the print unavailable region is set also in the section concerned on the second surface of the sheet.

At step S409, the unit image and maintenance patterns are sequentially printed on the second surface (the reverse surface) of the continuous sheet, which is rolled by the winding rotary body, in a predetermine order in accordance with the created second surface print schedule.

At step S410, it is determined whether all of the printing on the second surface defined in the second surface print schedule are completed (YES) or not (NO). If it is determined to be YES, it means that all the duplex printing is completed, so that the sequence is terminated. If it is determined to be NO, the procedure returns to step S410 to repeat the processing.

Figure 5:
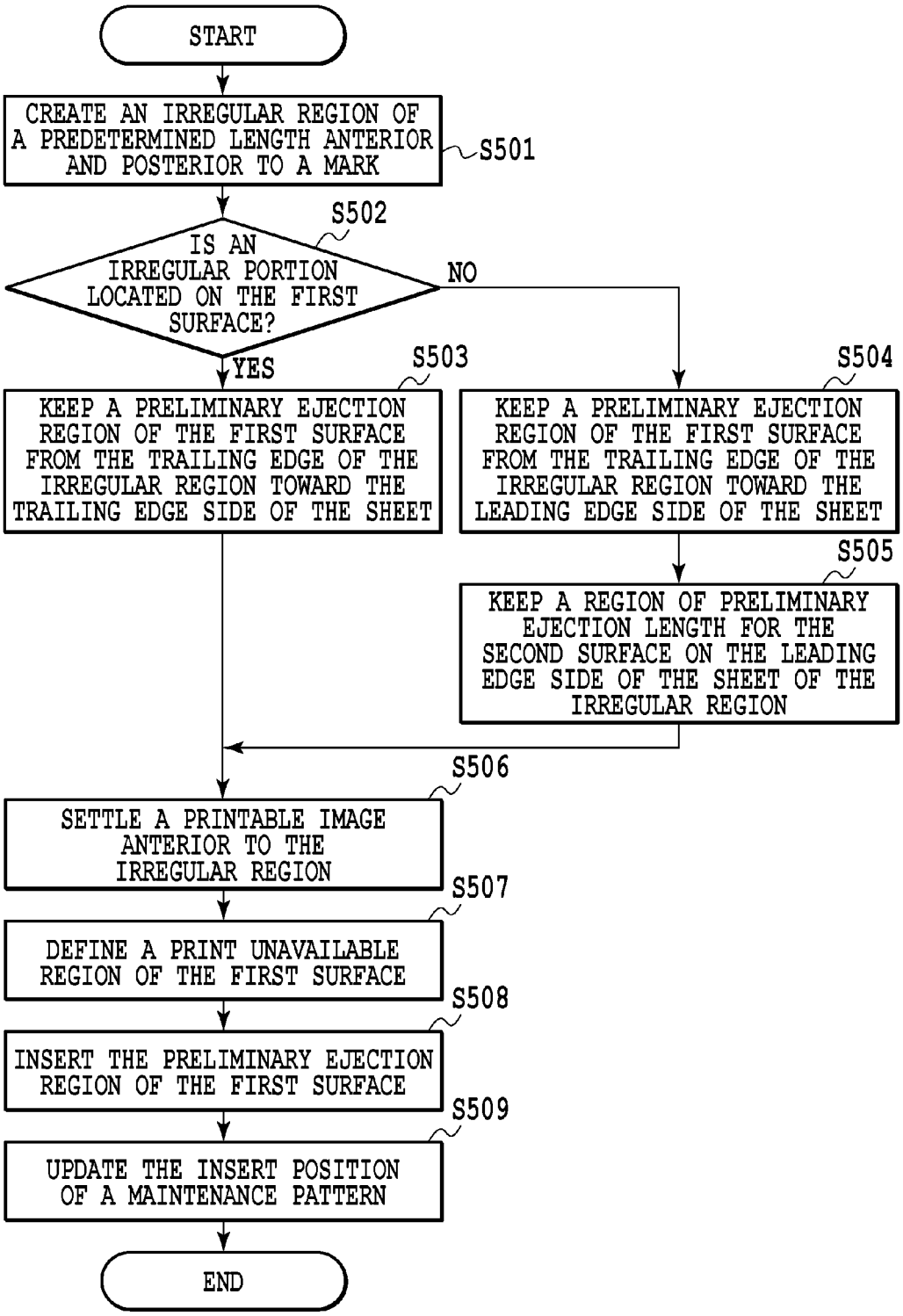
FIG. 5 is a flow chart showing an operation of the update processing of a first surface print schedule.

FIG. 5 is a flow chart showing an operational sequence of the update processing of the first surface print schedule at step S405 in FIG. 4.

At step S501, the region of a predetermined length is created anterior and posterior to the mark, and the unique region is created in the region on the reverse surface that corresponds to the region of the predetermined length. The unique region is the region which includes the unique portion composed of a part of the sheet having the characteristic different from the rest of the sheet. The length of the region may be determined previously, or may be settable at the printing apparatus. At step S502, it is determined whether the unique region is located on the first surface or the second surface by the mark pattern.

Also in the present embodiment, a single-line mark means that the unique region is located on the first surface, whereas a double-line mark means that the unique region is located on the second surface. If it is determined that the unique region is located on the first surface, the procedure proceeds to step S503. If it is determined that the unique region is located on the second surface, the procedure proceeds to step S504.

At step S503, a preliminary ejection region of the first surface is kept from the trailing edge of the unique region created at step S501 toward the trailing edge side of the sheet (in a normal region following the unique region). This is because the unique portion is located in the unique region on the first surface, and thus the unique region on the first surface cannot be used as the preliminary ejection region.

At step S504, a preliminary ejection region of the first surface (the first surface) is kept from the trailing edge of the unique region created at step S501 toward the leading edge side of the sheet, i.e., inside of the unique region (in the unique region). This is because the unique portion is located on the second surface, and thus the unique region on the first surface that is located at the reverse surface corresponding thereto is merely marked. There is no problem in quality except for the marked portion, and the portion can be used as the preliminary ejection region.

Then, the procedure proceeds to step S505. At step S505, a preliminary ejection region of the second surface (the second surface) is kept on the leading edge side of the sheet of the unique region created at step S501. This is because the printing on the second surface is executed from the trailing edge side of the sheet, so that, when the printing is executed, the unique region comes first, followed by the preliminary ejection region (the preliminary ejection region of the second surface) that is on the leading edge side of the sheet. Furthermore, since the unique portion is located on the second surface, the unique region on the second surface cannot be used as the preliminary ejection region.

At step S506, the printable image is settled in the position anterior to the unique region if the unique portion is located on the first surface, while being settled in the position anterior to the region of the preliminary ejection length of the second surface that is kept anterior to the unique region. More specifically, when the image to be printed is scheduled from the leading edge side of the sheet, it is determined to the extent of which image the printing is executed anterior to the unique region and from which image the printing is started by skipping the unique region.

At step S507, the start position and the end position of the print unavailable region of the first surface is defined. The start position of the print unavailable region is set to be the trailing edge of the image to be printed anterior to the unique region, which is settled at step S506. The end position of the print unavailable region is set to be the start position of the preliminary ejection region of the first surface that is kept at step S503 if it is determined at step S502 that the unique region is located on the first surface, or at step S504 if it is determined that the unique region is located on the second surface. Then, at step S508, the preliminary ejection region of the first surface is inserted posterior to the print unavailable region. Then, at step S509, the position for inserting a maintenance pattern, such as an ejection failure monitoring pattern, to the following image is updated.

The processing for keeping the print unavailable region and the preliminary ejection region in the vicinity of a mark in a case of detecting the mark will be described below using FIGS. 6 to 14.

Figure 6:
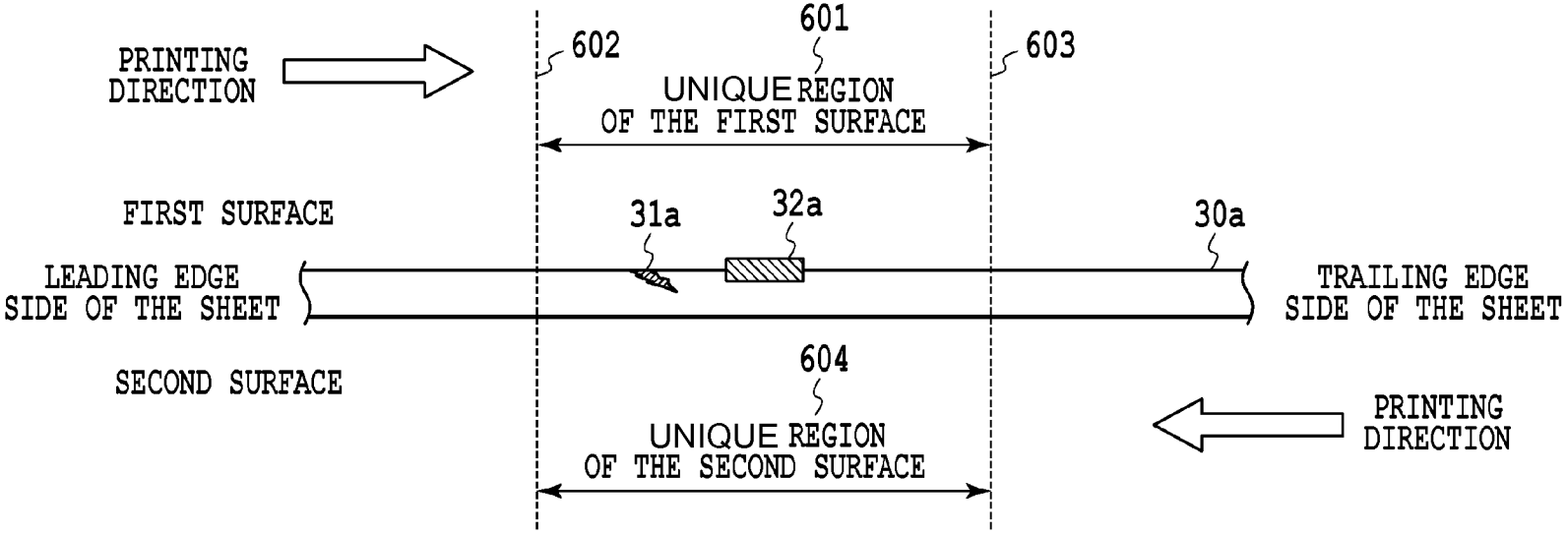
FIG. 6 is a diagram showing the unique region of a predetermined length created anterior and posterior to the mark.

FIGS. 6 to 9 are diagrams showing the unique region assigned in the vicinity of a mark indicating that the unique portion is located on the first surface when the mark is detected. In the figures, the upper side of the sheet 30*a* is the first surface, the lower side is the second surface, the left side is the leading edge side of the sheet, and the right side is the trailing edge side of the sheet. Furthermore, the printing direction of the first surface is the direction from the leading edge side of the sheet toward the trailing edge side of the sheet, and the printing direction of the second surface is in the opposite direction thereof. FIG. 6 is a diagram showing the unique region of a predetermined length including the unique portion 31*a* created anterior and posterior to the mark 32*a* by detecting the mark 32*a*.

A unique region of the first surface 601 is defined between a start position 602 and an end position 603. Furthermore, a unique region of the second surface 604 is created on the reverse side thereof. The unique region of the second surface 604 is defined between a start position 603 and an end position 602. This region is the region corresponding to the reverse side of the unique region of the first surface 601 where the unique portion 31*a* exists, and does not include the unique portion.

Figure 7:
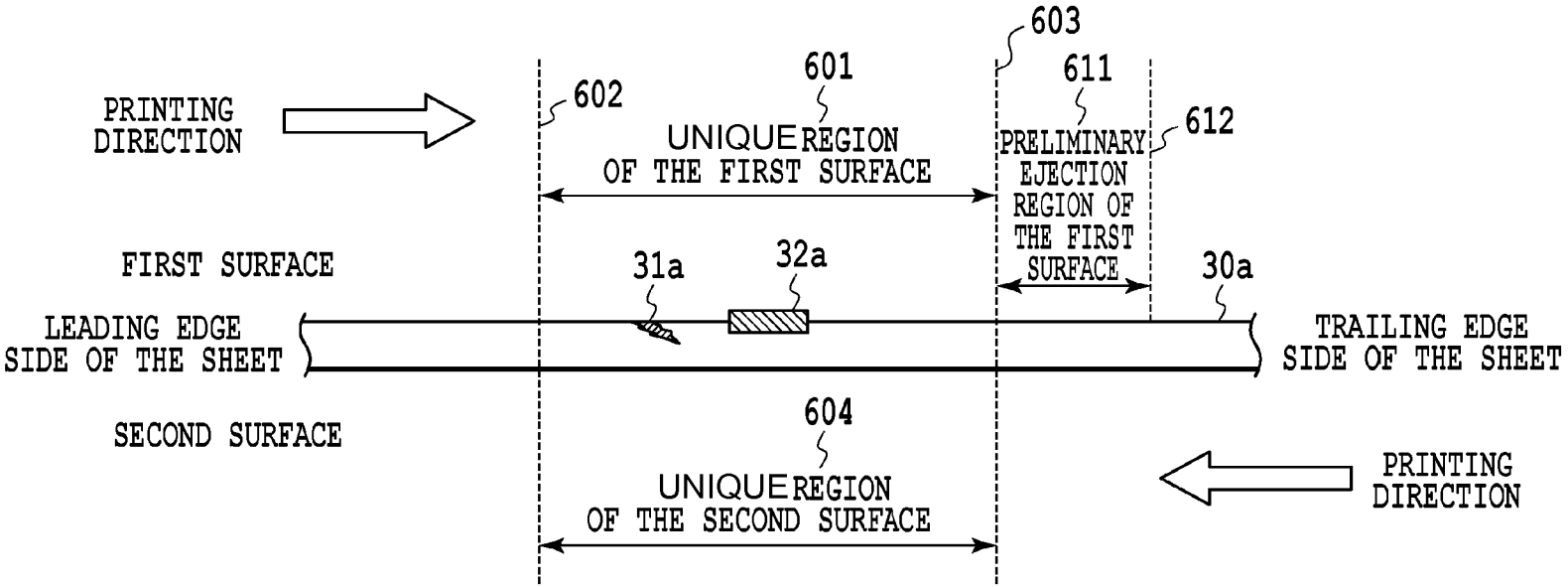
FIG. 7 is a diagram showing a preliminary ejection region of the first surface that is kept on the trailing edge side of the unique region of the first surface.

FIG. 7 is a diagram showing a preliminary ejection region of the first surface 611 that is kept on the trailing edge side of (posterior to) the sheet of the end position 603 of the unique region of the first surface after the unique regions are created on the first and second surfaces. The preliminary ejection region of the first surface 611 is provided between the end position 603 and the end position 612 of the unique region of the first surface.

Figure 8:
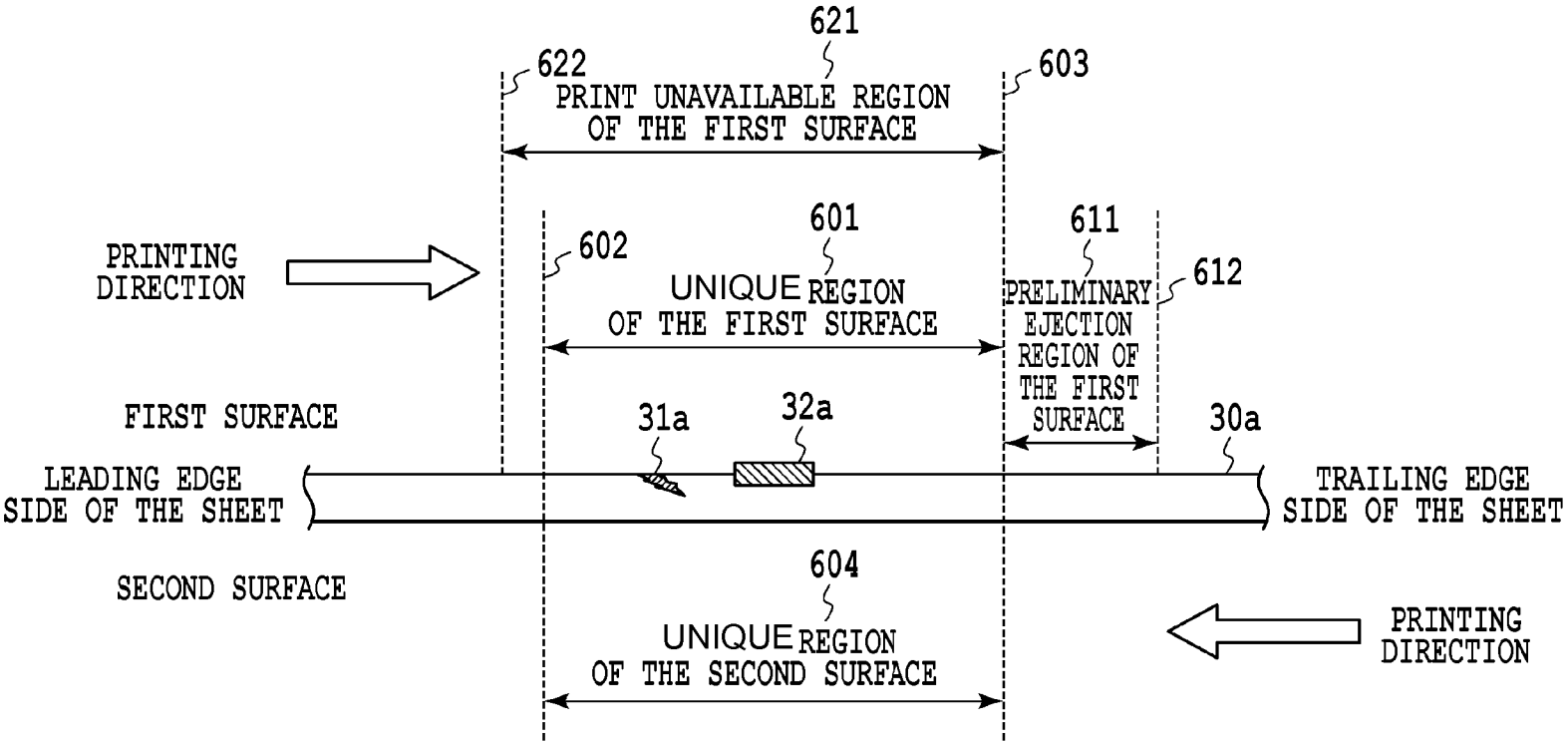
FIG. 8 is a diagram showing a print unavailable region of the first surface.

FIG. 8 is a diagram showing a print unavailable region of the first surface 621. In a case of updating the first surface print schedule, the images are arranged from the leading edge side of the sheet, and it is necessary to prevent the images and the unique region of the first surface 601 from overlapping with each other. At that time, the start position 622 of the print unavailable region of the first surface 621 serves as the trailing edge of the image to be printed anterior to the unique region of the first surface 601. Furthermore, the interval between the start position 622 of the print unavailable region of the first surface and the start position 602 of the unique region of the first surface 601 varies depending on the size of the image to be printed and the positional relationship with the mark.

Figure 9:
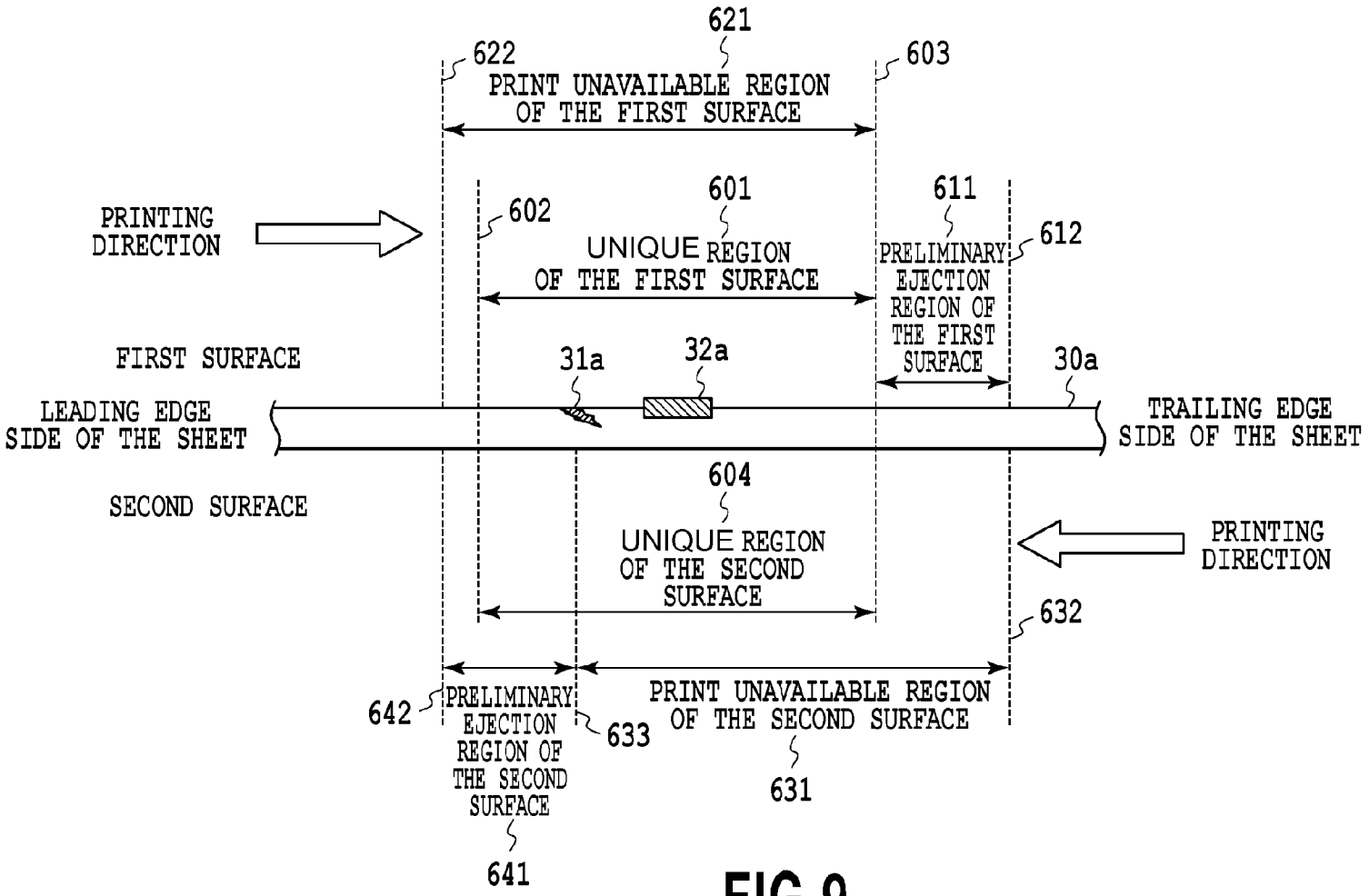
FIG. 9 is a diagram showing a print unavailable region of the second surface and a preliminary ejection region of the second surface.

FIG. 9 is a diagram showing a print unavailable region of the second surface 631 and a preliminary ejection region of the second surface 641 which are kept at the time of creating the second surface print schedule. When the second surface print schedule is created, the locations of the print unavailable region of the first surface 621 and the preliminary ejection region of the first surface 611 on the first surface are already revealed. Therefore, when the images to be printed on the second surface are arranged from the trailing edge side of the sheet, the trailing edge of the image to be printed on the reverse surface of the image that is arranged on the trailing edge side of the sheet of the preliminary ejection region of the first surface 611 serves as the start position 632 of the print unavailable region of the second surface 631.

At that time, the start position 632 of the print unavailable region of the second surface 631 corresponds with the end position 612 of the preliminary ejection region of the first surface 611. The length of the print unavailable region of the second surface 631 is same as that of the print unavailable region of the first surface 621, and the end position 633 of the print unavailable region of the second surface 631 serves as the start position of the preliminary ejection region of the second surface 641. Since the end position 642 of the preliminary ejection region of the second surface corresponds with the start position 622 of the print unavailable region of the first surface, the alignment of the images on the first surface and the second surface is correctly executed.

As described above, when the unique portion is located on the first surface, the print unavailable region of the first surface 621 includes the unique region of the first surface 601, and the printing on the unique region of the first surface 601 is completely avoided. Furthermore, the print unavailable region of the second surface 631 does not include the unique portion of the second surface 604, and the unique region of the second surface 604 is utilized as the preliminary ejection region.

Figure 10:
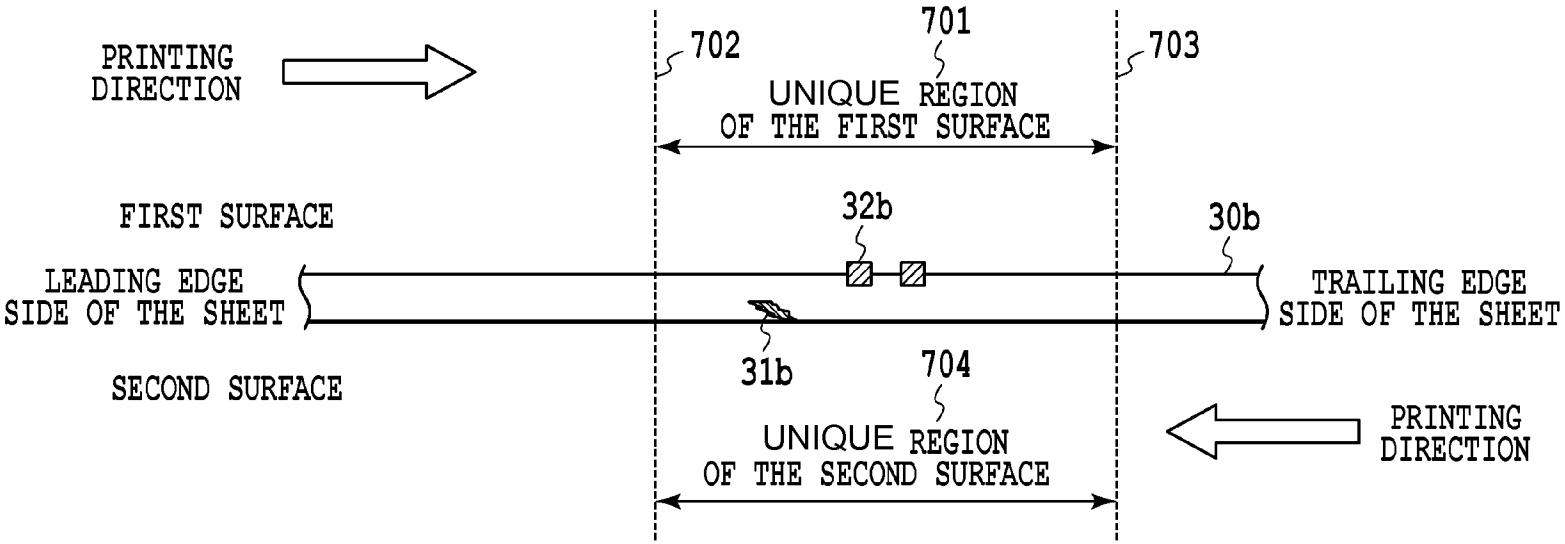
FIG. 10 is a diagram showing the unique region of a predetermined length including a unique portion that is created anterior and posterior to the mark.

FIGS. 10 to 14 are diagrams showing the unique region assigned in the vicinity of a mark indicating that the unique portion is located on the second surface when the mark is detected. In the figures, the upper side of the sheet 30*b* is the first surface, the lower side is the second surface, the left side is the leading edge side of the sheet, and the right side is the trailing edge side of the sheet. Furthermore, the printing direction of the first surface is the direction from the leading edge side of the sheet toward the trailing edge side of the sheet, and the printing direction of the second surface is in the opposite direction thereof. FIG. 10 is a diagram showing the unique region of a predetermined length including the unique portion 31*b* created anterior and posterior to the mark 32*b* by detecting the mark 32*a*. The start position of the unique region of the first surface 701 is denoted by 702, and the end position thereof is denoted by 703. Furthermore, a unique region of the second surface 704 is created on the reverse side thereof. The unique region of the second surface 704 is defined between the start position 703 and the end position 702.

Figure 11:
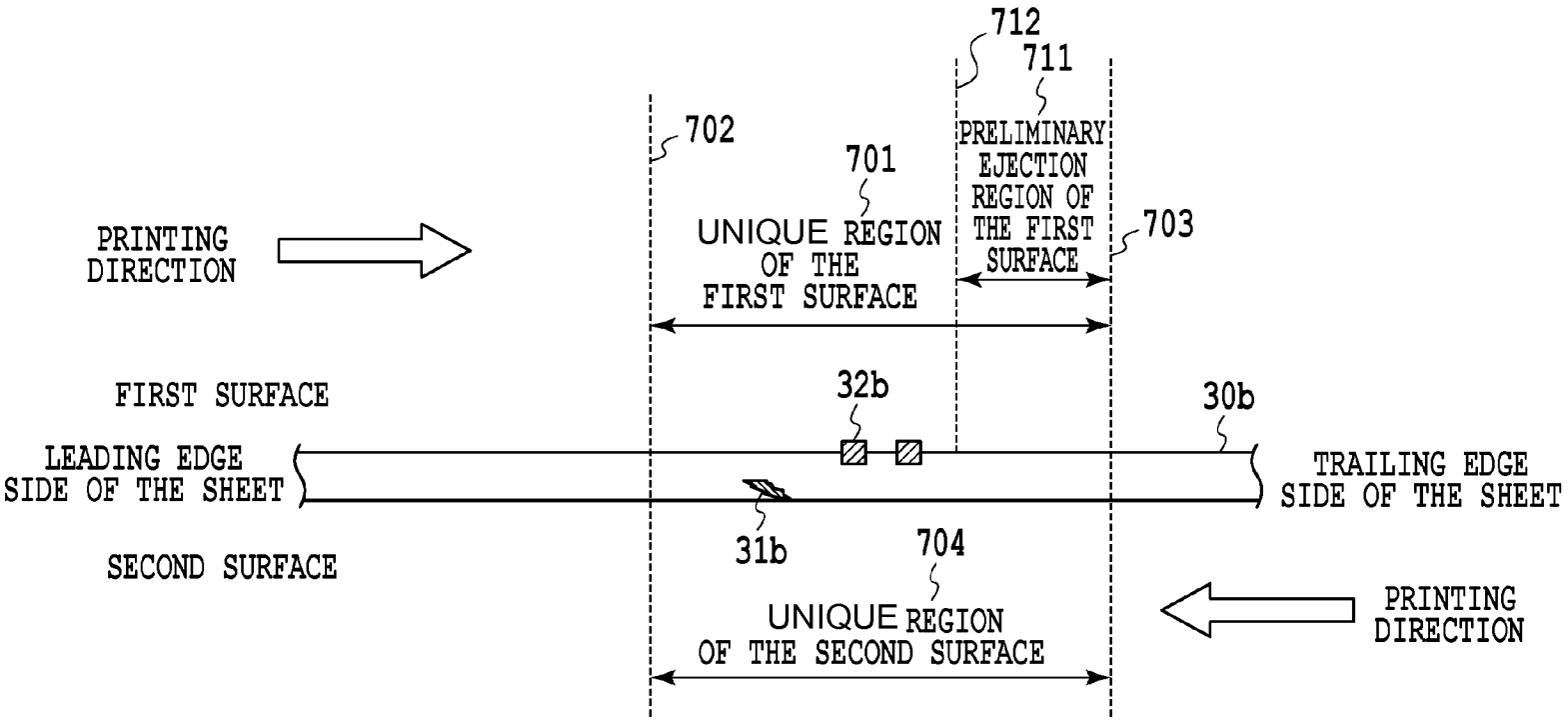
FIG. 11 is a diagram showing a preliminary ejection region of the first surface that is kept on the leading edge side of the unique region of the first surface.

FIG. 11 is a diagram showing a preliminary ejection region of the first surface 711 that is kept on the leading edge side of the sheet of the end position 703 of the unique region of the first surface after the unique regions are created on the first and second surfaces. The preliminary ejection region of the first surface 711 is defined between the start position 712 and the end position 703. Here, the unique region of the first surface 701 overlaps the preliminary ejection region of the first surface 711, but does not include the unique part. Therefore, the region can be used as a preliminary ejection region.

Figure 12:
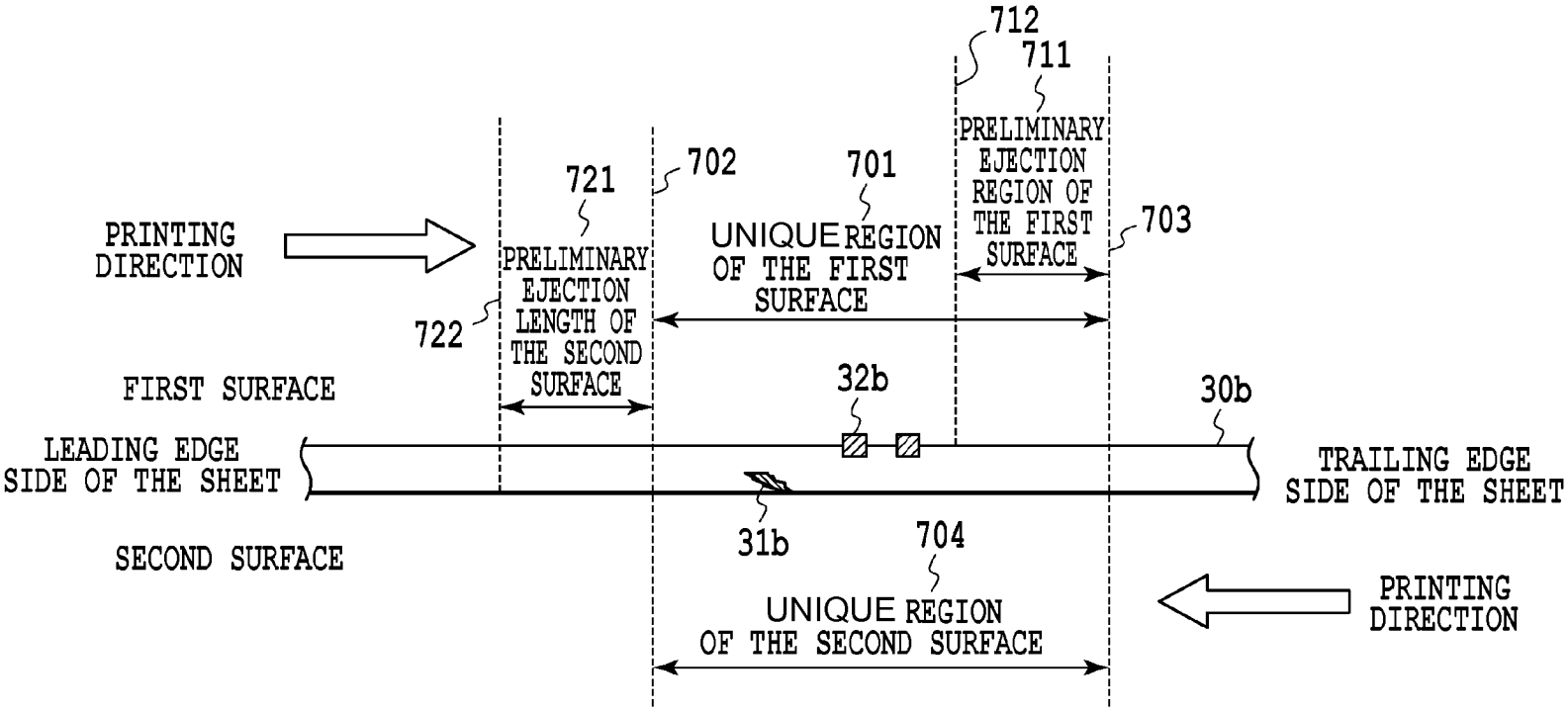
FIG. 12 is a diagram showing a preliminary ejection region of the second surface that is kept on the leading edge side of the unique region of the first surface.

FIG. 12 is a diagram showing a region of the preliminary ejection length of the second surface 721 that is kept on the leading edge side of the sheet of the start position 702 in the unique region of the first surface 701. When the mark indicating that the unique portion is located on the second surface is detected, it is necessary to keep the preliminary ejection region of the second surface on the leading edge side of the sheet that is nearer than the end position 702 of the unique region of the second surface, in a case of creating the second surface print schedule. Therefore, the region having the length required for the preliminary ejection of the second surface is previously kept as the region 721 of the preliminary ejection length of second surface at the time of updating the first surface print schedule. In this way, the region 721 of the preliminary ejection length for the second surface is defined between the start position 722 and the start position 702 of the unique region of the first surface 701.

Figure 13:
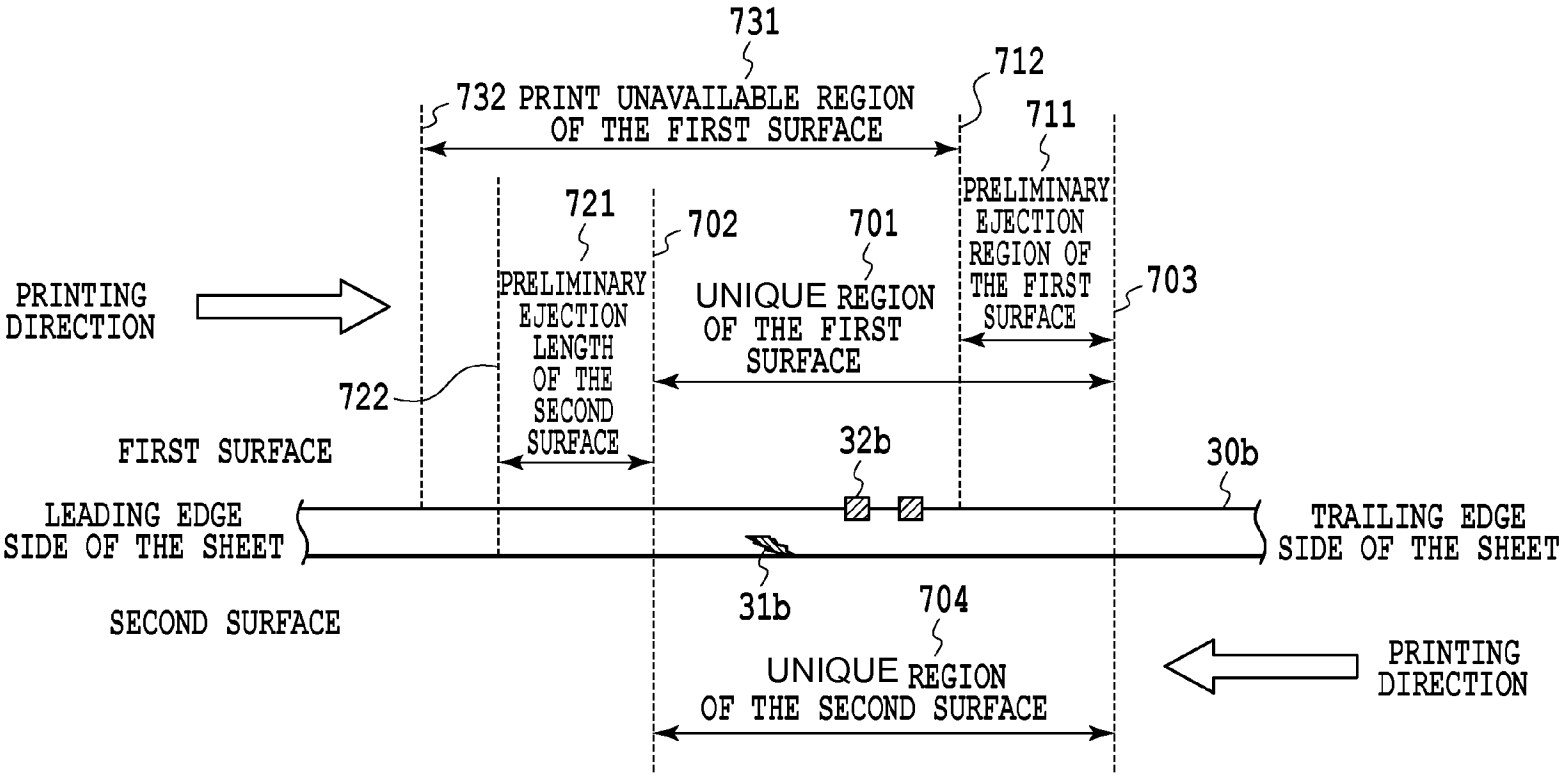
FIG. 13 is a diagram showing a print unavailable region of the first surface.

FIG. 13 is a diagram showing a print unavailable region of the first surface 731. In a case of updating the first surface print schedule, the images are arranged from the leading edge side of the sheet, and it is necessary to prevent the images and the region 721 of the preliminary ejection length of the second surface from overlapping with each other. At that time, the start position 732 of the print unavailable region of the first surface 731 serves as the trailing edge of the image to be printed anterior to the region 721 of the preliminary ejection length for the second surface. Furthermore, the interval between the start position 732 of the print unavailable region of the first surface and the start position 722 of the region 721 of the preliminary ejection length for the second surface varies depending on the size of the image to be printed and the positional relationship with the mark. The end position of the print unavailable region of the first surface 731 is the start position 712 of the preliminary ejection region of the first surface 711.

Figure 14:
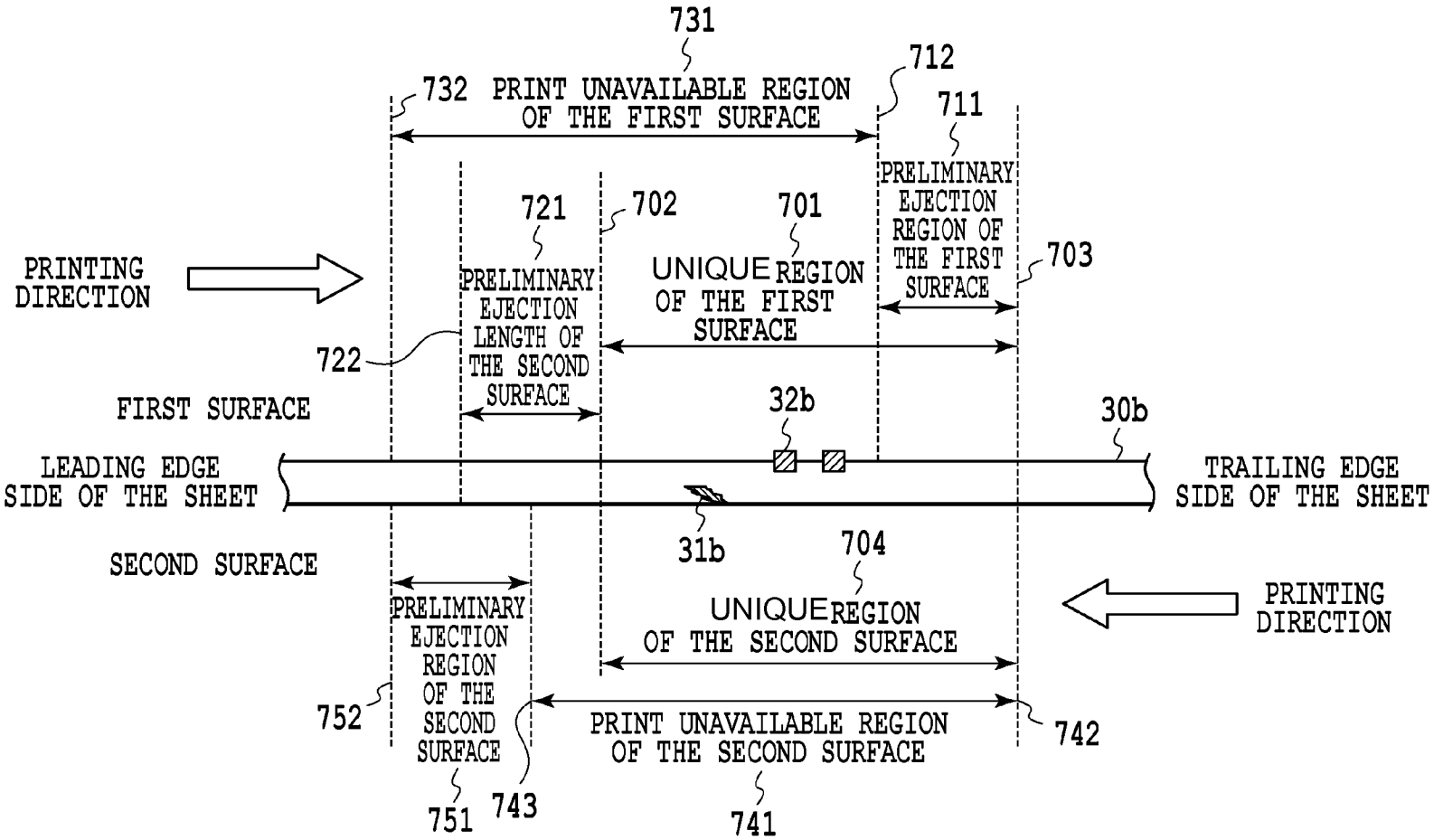
FIG. 14 is a diagram showing a print unavailable region of the second surface and a preliminary ejection region of the second surface.

FIG. 14 is a diagram showing a print unavailable region of the second surface 741 and a preliminary ejection region of the second surface 751 which are kept at the time of creating the second surface print schedule. When the second surface print schedule is created, the locations of the print unavailable region of the first surface 731 and the preliminary ejection region of the first surface 711 on the first surface are already revealed. Therefore, when the images to be printed on the second surface are arranged from the trailing edge side of the sheet, the trailing edge of the image to be printed on the reverse surface of the image that is arranged on the trailing edge side of the sheet of the preliminary ejection region of the first surface 711 serves as the start position 742 of the print unavailable region of the second surface 741.

At that time, the start position 742 of the print unavailable region of the second surface corresponds with the end position 703 of the unique region of the first surface 701 and the preliminary ejection region of the first surface 711. The length of the print unavailable region of the second surface 741 is same as that of the print unavailable region of the first surface 731, and the end position 743 of the print unavailable region of the second surface 741 serves as the start position of the preliminary ejection region of the second surface 751. In addition, the preliminary ejection region of the second surface 751 also can be arranged immediately anterior to the end position 702 of the unique region of the second surface 704, i.e., on the exact reverse side of the region 721 of the preliminary ejection length for the second surface.

In such a case, however, producing a gap between the preliminary ejection region of the second surface 751 and the following image may cause deterioration in the image quality. It is thus desirable to minimize the interval between the preliminary ejection region of the second surface 751 and the following image. Therefore, the start position 742 of the print unavailable region of the second surface 741 corresponds with the end position 703 of the preliminary ejection region of the first surface 711, and the end position 752 of the preliminary ejection region of the second surface 751 corresponds with the start position 732 of the print unavailable region of the first surface 731. The positions are brought into correspondence with each other in this way, so that the alignment of the images on the first surface and the second surface is correctly executed.

As described above, when the unique portion is located on the second surface, the print unavailable region of the second surface 741 includes the unique region of the second surface 704, and the printing on the unique region of the second surface 704 is completely avoided. Furthermore, the print unavailable region of the first surface 731 does not include the unique region of the first surface 701, and the unique region of the first surface 701 is effectively utilized as the preliminary ejection region.

Then, an example of update processing of the first surface print schedule, and an example of creating processing of the second surface print schedule will be described using FIGS. 15A to 16C. In each of FIGS. 15A to 15C and FIGS. 16A to 16C, the upper side of the figure is the leading edge side of the continuous sheet, and the lower side is the trailing side of the continuous sheet. More specifically, the printing proceeds from the upper side to the lower side at the time of printing on the first surface (FIGS. 15A and 15B, and FIGS. 16A and 16B), whereas the printing proceeds from the lower side to the upper side at the time of printing on the second surface (FIG. 15C and FIG. 16C).

Figure 15A:
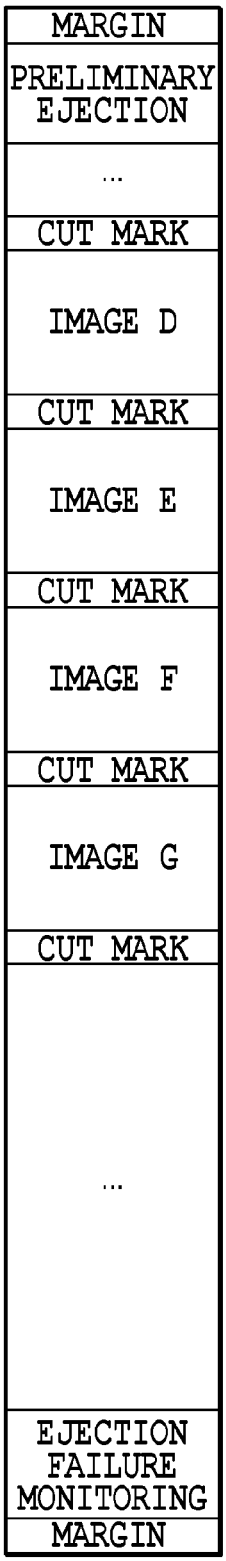
FIGS. 15A to 15C are diagrams showing a print schedule.
Figure 15B:
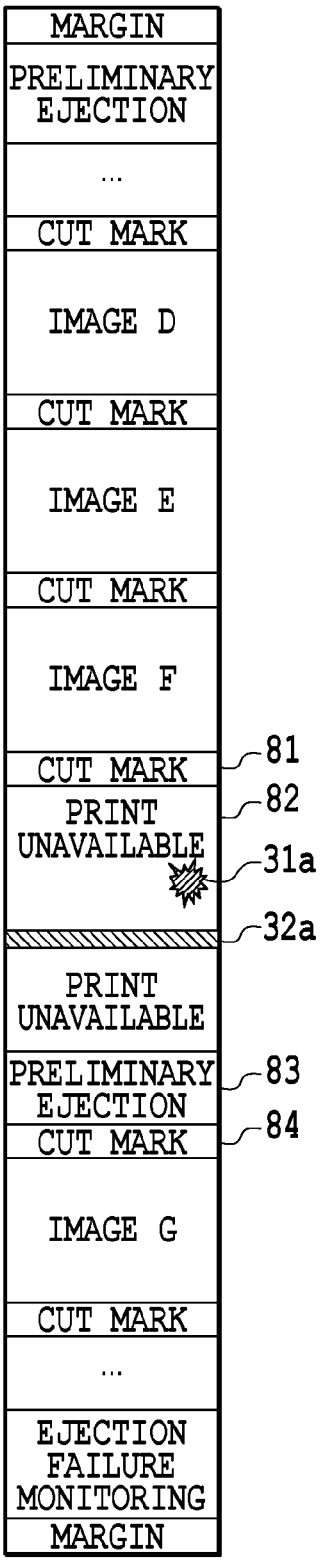

FIG. 15A is a diagram showing an initial first surface print schedule created at step S401 (refer to FIG. 4). In this case, the schedule is created so that the preliminary ejection is inserted at the top of the printing, and the ejection failure monitoring patterns are inserted at predetermined intervals and at the end of the image. FIG. 15B is an example of the updated first surface print schedule in a case where a marked portion detection processing at step S404 detects that the unique portion is located on the first surface side during the printing.

The unique region of a predetermined length is created anterior and posterior to the mark 32*a*, and it is determined to the extent of which image the printing can be executed anterior to the unique region. If the determination result is obtained in which the printing can be done to a cut mark 81 posterior to an image F, the start position of a print unavailable region 82 is defined at the trailing edge of the cut mark 81 posterior to the image F. The end position of the print unavailable region 82 is still at the end position of the unique region. The print unavailable region 82 is defined, and then a preliminary ejection region of the first surface 83 and a cut mark 84 are inserted posterior thereto. With regard to a following image G and the images subsequent thereto, the insertion position is updated so that the maintenance patterns are inserted at predetermined intervals.

Figure 15C:
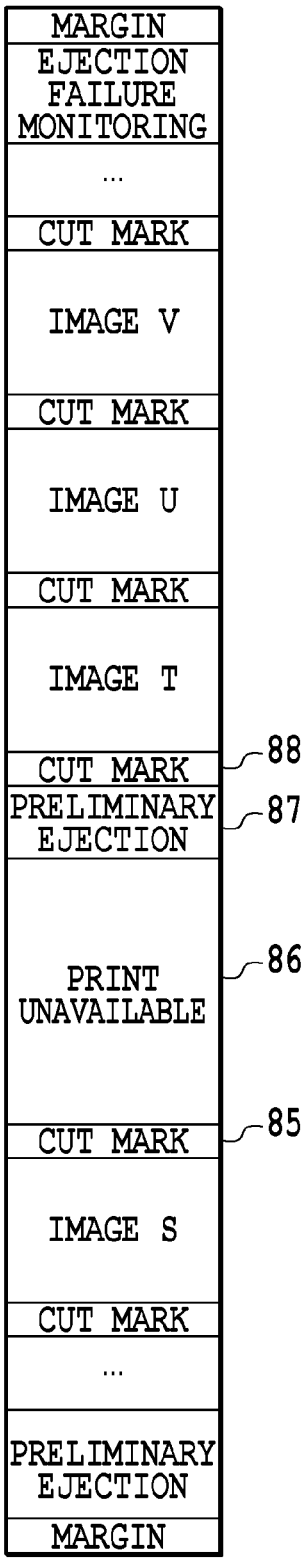

FIG. 15C is an example of the second surface print schedule created at step S408 based on the updated first surface print schedule in FIG. 15B. The schedule is created so that each of the images is arranged at the position on the second surface which is opposite to each of the images on the first surface, such as an image D to an image V. On the second surface, since the printing is executed from the trailing edge side of the continuous sheet, the trailing edge of the cut mark 85 posterior to an image S opposite to an image G serves as the start position of a print unavailable region of the second surface 86. The length of the print unavailable region of the second surface 86 is equal to that of the print unavailable region of the first surface 82, and a preliminary ejection region of the second surface 87 and a cut mark 88 are inserted posterior to the print unavailable region of the second surface 86.

As described above, the print unavailable region is arranged so that the image is not arranged in the unique region of the first surface, and the preliminary ejection region of the first surface 83 is arranged posterior thereto. Furthermore, the preliminary ejection region of the second surface 87 is arranged at the position overlapped with the print unavailable region of the first surface 82. This is because the marked portion detection processing at step S404 (refer to FIG. 4) detects that the unique portion is located on the first surface side, so that the second surface does not include any unique portions and can be utilized for the maintenance processing of the print head.

Figure 16A:
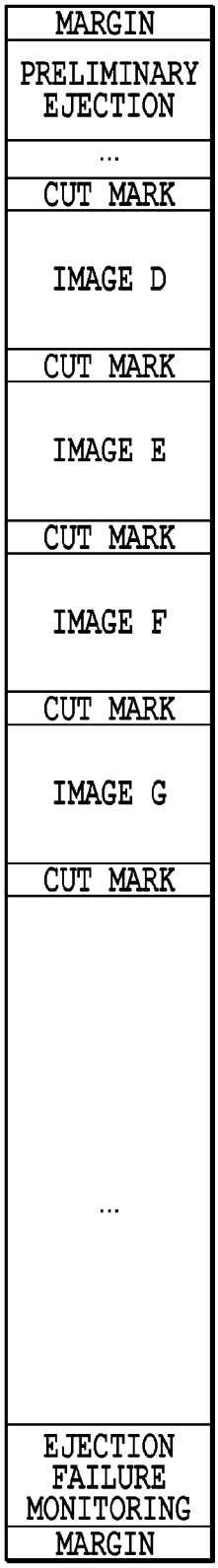
FIGS. 16A to 16C are diagrams showing a print schedule.
Figure 16B:
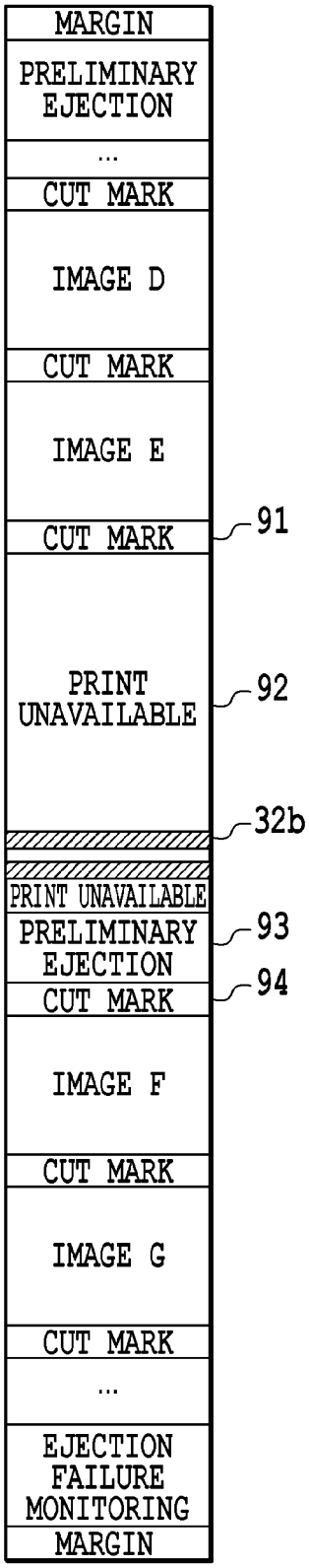
Figure 16C:
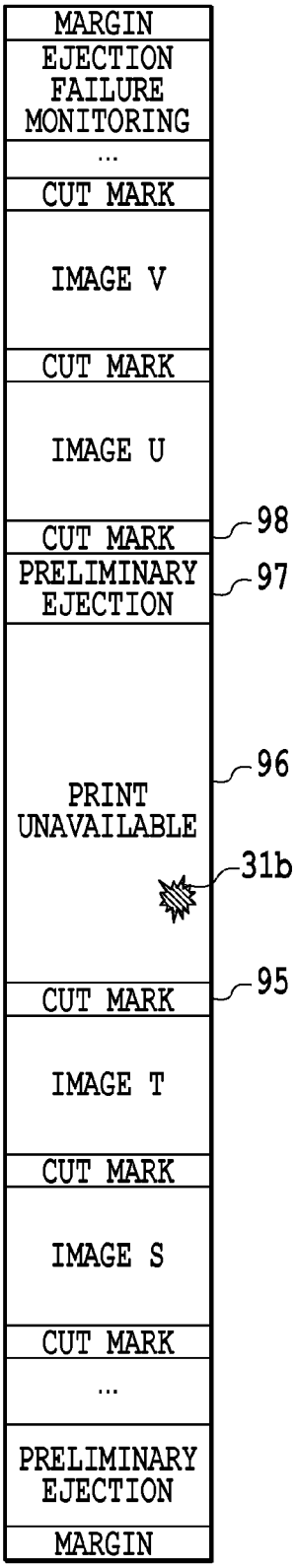

FIG. 16A is a diagram showing an initial first surface print schedule created at step S401 (refer to FIG. 4). Similar to FIG. 15A, the schedule is created so that the preliminary ejection is inserted at the top of the printing, and the ejection failure monitoring patterns are inserted at predetermined intervals and at the end of the image. FIG. 16B is an example of the updated first surface print schedule in a case where a marked portion detection processing at step S404 detects that the unique portion is located on the second surface side opposite to the first surface during the printing.

First, a unique region of a predetermined length is created anterior and posterior to the mark 32*b*. The actual unique portion such as a stain is located on the reverse side of the unique region created here, i.e., in the unique region of the second surface, so that the first surface can be utilized for the head maintenance except for the marked portion. Therefore, the preliminary ejection region of the first surface 93 is kept from the trailing edge of the unique region to the inside of the unique region, i.e., toward the leading edge side of the sheet, and further the region of the preliminary ejection length of the second surface is kept from the leading edge of the unique region toward the leading edge side of the sheet.

In this state, it is determined to the extent of which image the printing can be executed anterior to the kept region of the preliminary ejection length of the second surface. If it is resultingly determined that the printing can be executed to an image E, the trailing edge of a cut mark 91 posterior to the image E serves as the start position of the print unavailable region 92, and the end position of the print unavailable region 92 is positioned on the side of the leading edge of the sheet for the length from the trailing edge of the unique region to the preliminary ejection region of the first surface 93. The print unavailable region 92 is defined, and then the preliminary ejection region of the first surface 94 is inserted posterior thereto. The preliminary ejection region of the first surface 93 is inserted, followed by a cur mark 94. Then, a following image F and the images subsequent thereto are arranged. Furthermore, the insertion position is updated so that the maintenance patterns are inserted at predetermined intervals.

FIG. 16C is an example of the second surface print schedule created at step S408 based on the updated first surface print schedule in FIG. 16B. The schedule is created so that each of the images is arranged at the position on the first surface which is opposite to each of the images on the second surface, such as an image D to an image V. On the second surface, since the printing is executed from the trailing edge side of the continuous sheet, the trailing edge of the cut mark 95 posterior to an image T opposite to an image F serves as the start position of a print unavailable region of the second surface 96.

The length of the print unavailable region of the second surface 96 is equal to that of the print unavailable region of the first surface 92, and a preliminary ejection region of the second surface 97 and a cut mark 98 are inserted posterior to the print unavailable region of the second surface 96.

As described above, the print unavailable region 96 is arranged so that the image is not arranged in the unique region of the second surface, and the preliminary ejection region 97 is inserted posterior thereto. Furthermore, the preliminary ejection region of the first surface 93 is arranged inside of the unique region of the first surface. This is because the marked portion detection processing at step S404 detects that the unique portion is located on the second surface side, so that the first surface does not include any unique portions and can be utilized for the maintenance processing of the print head.

In the present embodiment, it is confirmed which of the surfaces out of the first and second surfaces include a unique portion by means of a mark applied on the sheet, and the unique region is created at the predetermined length anterior and posterior to the mark. Then, when the first surface includes the unique portion, the preliminary ejection region is provided posterior to the unique region on the first surface and, on the second surface, the preliminary ejection region is provided posterior to the print unavailable region including the unique region on the second surface. In contrast, when the second surface includes the unique portion, the preliminary ejection region including the trailing edge portion of the unique region of the first surface is provided in the unique region on the first surface and, on the second surface, the print unavailable region is provided, followed by the preliminary ejection region.

If a more general, a print unavailable region including a unique portion and a maintenance region following thereto are set on a specific sheet surface on which a unique portion exists, and also, on a sheet surface which is a reverse side of the specific sheet surface, a print unavailable region is set so as to include a region corresponding to the maintenance region, and also a maintenance region following thereto is set. The regions (a total of the print unavailable regions and the maintenance regions), which are set on each of the specific sheet surface and the sheet surface on the reverse side thereof so that an image cannot be printed due to the unique portion, correspond with each other on the observe and reverse sides of the sheet in terms of locations and lengths.

Furthermore, in the continuous sheet for use in the printing method based on such a technical idea, information indicating the location of the unique portion is previously recorded on the continuous sheet itself. Alternatively, the information is collectively recorded on a package of the continuous sheet, or is collectively recorded in a memory media attached to the package. The unique portion thus can be detected by acquiring the information. Namely, the continuous sheet itself is characteristic.

According to the embodiments described above, even If a unique portion exists on a sheet when a plurality of images is sequentially printed on both the surfaces of the continuous sheet, the optimum scheduling including maintenance of the print head enables the amount of consumption of the sheet to be suppressed as a whole.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-169937, filed Jul. 31, 2012, which is hereby incorporated by reference herein in its entirety.

What is claimed is:

1. A print control method for printing plurality of images on a first surface and a second surface of a continuous sheet, the method comprising:

acquiring information regarding on which of the first and second surfaces and where on the surface of the continuous sheet a unique portion exist, the unique portion is unsuitable for image printing that exists on the continuous sheet; and printing images on the first surface of the continuous sheet and then printing images on the second surface of the continuous sheet, based on the acquired information, so as not to print the images on a print unsuitable region including the unique portion wherein in a case where the unique portion is located on the first surface, a maintenance pattern is printed on the first surface in a region posterior to the print unsuitable region on the first surface of the continuous sheet, and a maintenance pattern is on the second surface so as to overlap at least a portion of a region corresponding to the print unsuitable region, and in a case where the unique portion is located on the second surface, the maintenance pattern is printed on the first surface so as to overlap at least a portion of a region corresponding to the print unsuitable region on the first surface of the continuous sheet and the maintenance pattern is printed on the second surface in a region posterior to the print unsuitable region on the second surface of the continuous sheet.

2. The method according to claim 1, wherein a region of the first surface consisting of a print unavailable region including the unsuitable region and a maintenance region on which the maintenance pattern is printed and a region of the second surface consisting of a print unavailable region including the unsuitable region and a maintenance region on which the maintenance pattern is printed are at the same location on the continuous sheet and have the same length.

3. The method according to claim 1, wherein:

in a case where the unique portion is located on the first surface, the maintenance pattern set on the first surface is adjacent to the print unsuitable region of the first surface; and in a case where the unique portion is located on the second surface, the maintenance pattern set on the second surface is posterior to the print unsuitable region of the second surface with an interval between them.

4. The method according to claim 1, wherein information is recorded as a mark on one surface of the continuous sheet, the information indicating the location of the unique portion and on which surface out of the first and the second surfaces the unique portion exists, and the information is acquired by reading the mark.

5. The method according to claim 4, wherein the information is collectively recorded on a package of the continuous sheet, or is collectively recorded in a memory media attached to a package of the continuous sheet.

6. The method according to claim 4, wherein the print unsuitable region is set based on the information.

7. The method according to claim 1, wherein the print unsuitable region includes the unique portion and a mark indicating the unique portion.

8. An apparatus for printing a plurality of images on a first surface and a second surface of a continuous sheet, the apparatus comprising:

an acquiring unit configured to acquire information regarding on which of the first and second surfaces and where on the surface of the continuous sheet a unique portion exist, the unique portion being unsuitable for image printing that exist on the continuous sheet; and a print control unit configured to cause a print unit to print images on the first surface of the continuous sheet and then print images on the second surface of the continuous sheet, based on the acquired information, so as not to print images on a print unsuitable region including the unique portion, wherein in a case where the unique portion is located on the first surface, the print control unit causes the print unit to print a maintenance pattern on the first surface in a region posterior to the print unsuitable region on the first surface of the continuous sheet and causes the print unit to print a maintenance pattern on the second surface so as to overlap at least a portion of a region corresponding to the print unsuitable region, and in case where the unique portion is located on the second surface, the print control unit causes the print unit to print the maintenance pattern on the first surface so as to overlap at least a portion of a region corresponding to the print unsuitable region on the first surface of the continuous sheet, and causes the print unit to print the maintenance pattern on the second surface in a region posterior to the print unsuitable region on the second surface of the continuous sheet.

9. The apparatus according to claim 8, further comprising the print unit.

10. The apparatus according to claim 8, wherein a region of the first surface consisting of a print unavailable region including the print unsuitable region and a maintenance region on which the maintenance pattern is printed and a region of the second surface consisting of a print unavailable region including the print unsuitable region and a maintenance region on which the maintenance pattern is printed are at the same location on the continuous sheet and have the same length.

11. The apparatus according to claim 8, wherein in a case where the unique portion is located on the first surface, the maintenance pattern set on the first surface is adjacent to the print unsuitable region of the first surface, and in a case where the unique portion is located on the second surface, the maintenance pattern is set on the second surface is posterior to the print unsuitable region of the second surface with an interval between them.

12. The apparatus according to claim 8, wherein information is recorded as a mark on one surface of the continuous sheet, the information indicates the location of the unique portion and on which surface out of the first and the second surfaces the unique portion exists, and the information is acquired by reading the mark.

13. The apparatus according to claim 12, wherein the information is collectively recorded on a package of the continuous sheet, or is collectively recorded in memory media attached to a package of the continuous sheet.

14. The apparatus according to claim 12, wherein the print unsuitable region is set based on the information.

15. The apparatus according to claim 8, wherein the print unsuitable region includes the unique portion and a mark indicating the unique portion.

* * * * *